US010974532B2

(12) United States Patent
Kishi et al.

(10) Patent No.: US 10,974,532 B2
(45) Date of Patent: Apr. 13, 2021

(54) TEETH PART, BINDER, PAPER-PROCESSING APPARATUS, AND IMAGE FORMATION SYSTEM

(71) Applicant: MAX CO., LTD., Tokyo (JP)

(72) Inventors: Kazuhiko Kishi, Tokyo (JP); Tatsuya Kenjo, Tokyo (JP); Masashi Shimamura, Tokyo (JP); Kazuya Igata, Tokyo (JP); Katsuya Hakozaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 210 days.

(21) Appl. No.: 16/304,237

(22) PCT Filed: May 31, 2017

(86) PCT No.: PCT/JP2017/020191
§ 371 (c)(1),
(2) Date: Nov. 23, 2018

(87) PCT Pub. No.: WO2017/209162
PCT Pub. Date: Dec. 7, 2017

(65) Prior Publication Data

US 2020/0316978 A1 Oct. 8, 2020

(30) Foreign Application Priority Data

May 31, 2016 (JP) ..... JP2016-109564

(51) Int. Cl.
*B42B 5/10* (2006.01)
*B31F 5/02* (2006.01)
(Continued)

(52) U.S. Cl.
CPC ..... *B42B 5/10* (2013.01); *B31F 5/02* (2013.01); *B65H 37/04* (2013.01)

(58) Field of Classification Search
CPC ..... B42B 5/10; B65H 37/04; B31F 5/02
(Continued)

(56) References Cited

U.S. PATENT DOCUMENTS 2,188,222 A 1/1940 Hibbs
2014/0003852 A1 1/2014 Abe et al.
(Continued)

FOREIGN PATENT DOCUMENTS

EP 2 732 962 A2 5/2014
EP 2 829 410 A1 1/2015
(Continued)

OTHER PUBLICATIONS

Supplementary European Search Report issued in Application No. 17806714.6, dated Jan. 22, 2020, 7 pages.
(Continued)

*Primary Examiner* — Justin V Lewis
(74) *Attorney, Agent, or Firm* — Rothwell, Figg, Ernst & Manbeck, P.C.

(57) ABSTRACT

A pair of tooth portions has a plurality of convex portions and is arranged to engage with each other when approaching each other. The convex portion of at least one tooth portion of the pair of tooth portions has, on an opposing surface thereof opposing the convex portion of the other tooth portion, an abutting surface abutting against the convex portion of the other tooth portion when the pair of tooth portions is engaged with each other and a non-abutting surface not abutting against the convex portion of the other tooth portion when the pair of tooth portions is engaged with each other.

11 Claims, 31 Drawing Sheets

(51) Int. Cl.
*B65H 37/04* (2006.01)
*B42B 5/00* (2006.01)

(58) Field of Classification Search
USPC ..... 412/9, 22, 33, 34; 270/32, 37, 52.18, 270/58.07, 58.08
See application file for complete search history.

(56) References Cited

U.S. PATENT DOCUMENTS

| | | | | |
|---|---|---|---|---|
| 2014/0138896 | A1* | 5/2014 | Yoshida ..... | B31F 5/02 270/58.11 |
| 2015/0030414 | A1 | 1/2015 | Takahashi et al. | |
| 2016/0107409 | A1 | 4/2016 | Kubo | |
| 2018/0370177 | A1 | 12/2018 | Awano et al. | |

FOREIGN PATENT DOCUMENTS

| | | | |
|---|---|---|---|
| JP | 2014-040307 | A | 3/2014 |
| JP | 2014-073681 | A | 4/2014 |
| JP | 2014-121865 | A | 7/2014 |
| JP | 2014-162106 | A | 9/2014 |
| JP | 2015-024891 | A | 2/2015 |
| WO | 2014208237 | A1 | 12/2014 |
| WO | 2017/169791 | A1 | 10/2017 |

OTHER PUBLICATIONS

International search report ISA/210 in PCT/JP2017/020191, dated Aug. 22, 2017, 2 pages.
Written opinion ISA/237 in PCT/JP2017/020191, dated Aug. 22, 2017, 7 pages.

* cited by examiner

FIG.25

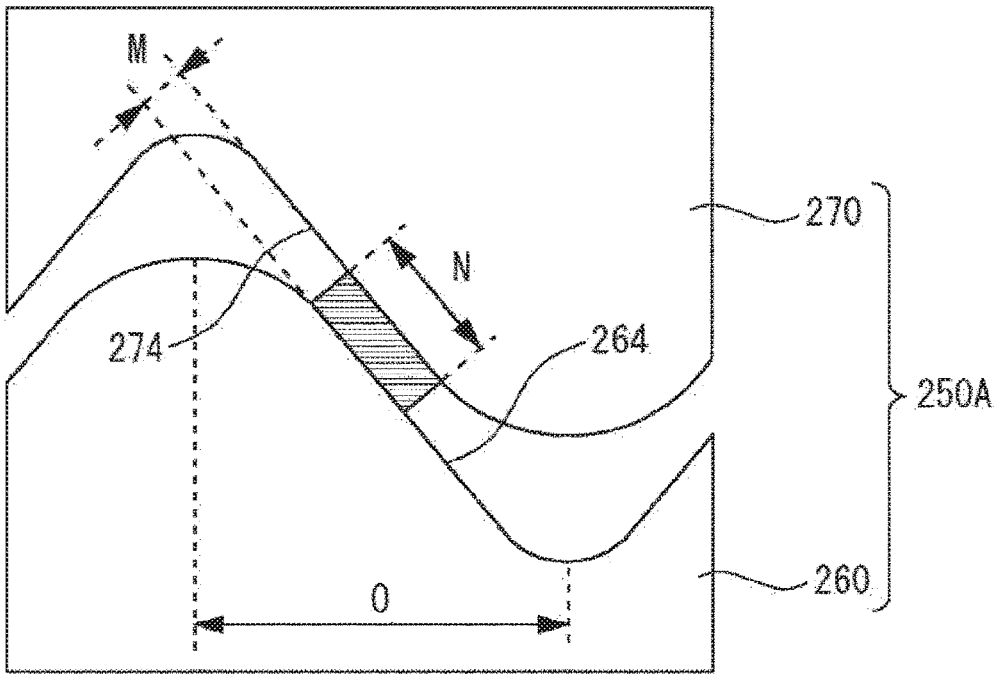

FIG.26

| TYPES OF TEETH | EXAMPLE 1 | EXAMPLE 2 | EXAMPLE 3 | COMPARATIVE EXAMPLE 1 | COMPARATIVE EXAMPLE 2 | COMPARATIVE EXAMPLE 3 |
|---|---|---|---|---|---|---|
| DISTANCE BETWEEN PEAK AND VALLEY OF TEETH: O | 0.63 | 0.82 | 0.96 | 0.27 | 0.55 | 1.09 |
| SIDE SURFACE SEPARATION DISTANCE WHEN COMPRESSIVE CONTACT DISTANCE N BECOMES 0MM: M | 0.23 | 0.30 | 0.35 | 0.10 | 0.20 | 0.40 |
| BINDING RETENTION FORCE OF TWO SHEETS | ○ | ○ | ○ | ○ | ○ | × |
| BINDING RETENTION FORCE OF FIVE SHEETS | ◎ | ◎ | ◎ | ○ | ○ | ○ |
| BINDING RETENTION FORCE OF TEN SHEETS | ○ | ○ | ◎ | × | × | ◎ |

FIG.30A
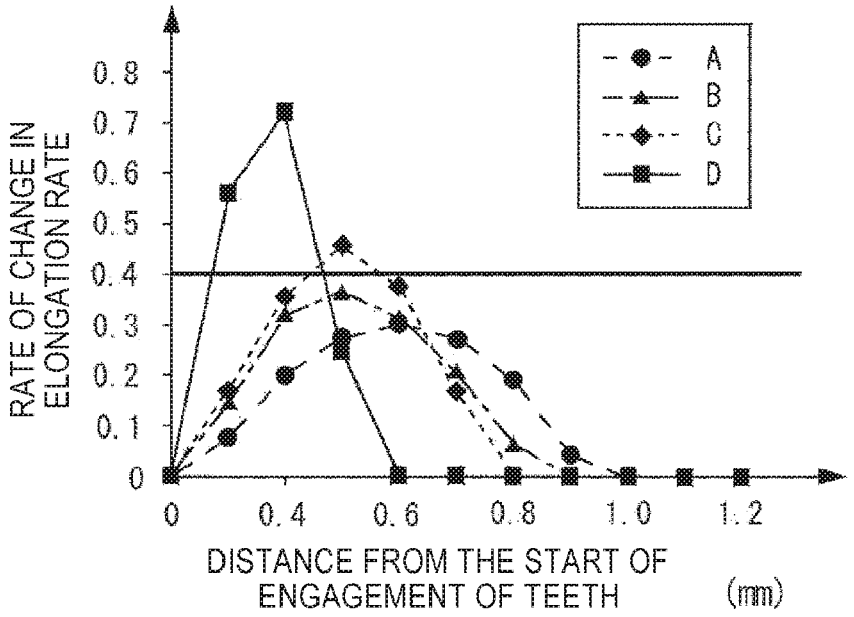
FIG.30B
| | A | B | C | D |
|---|---|---|---|---|
| SHAPE OF TEETH | 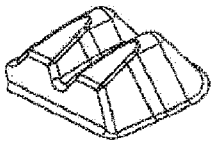 | 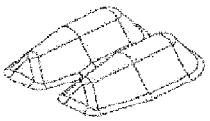 | 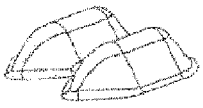 | 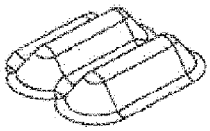 |
| TEARING IN BOUND BOOKLET | ○ | ○ | × | × |

TEETH PART, BINDER, PAPER-PROCESSING APPARATUS, AND IMAGE FORMATION SYSTEM

CROSS REFERENCE TO RELATED APPLICATIONS

This application is a 35 U.S.C. 371 National Phase Entry Application from PCT/JP2017/020191, filed May 31, 2017, which claims priority to Japanese Patent Application No. 2016-109564, filed May 31, 2016, the disclosures of which are incorporated herein in their entirety by reference, and priority is claimed to each of the foregoing.

TECHNICAL FIELD

The present invention relates to a tooth portion, a binder, a paper processing apparatus and an image formation system.

BACKGROUND ART

Conventionally a binder for binding a paper bundle formed by stacking a plurality of sheets of paper, a paper processing apparatus equipped with the binder and the like have been widely used. As the binder, ones using staples were common. However, recently, binding means which do not use a metal material, such as staples, attract attention from the viewpoints of resource saving, environmental measures and recyclability. As binding means which do not use a metal material, for example, a binding means is known, which binds a paper bundle by pressing and crimping the paper bundle in a thickness direction by means of a pair of upper and lower teeth.

For example, in a binder of Patent Document 1, an absolute value of an inclination angle of inclined surface portions of a pair of teeth with respect to a contact and separation direction of the teeth is configured to be less than 380. Then, the inclined surface portions of the teeth crimp a paper bundle stacked between the teeth while elongating a paper material, thereby binding sheets of paper.

In addition, a paper processing apparatus of Patent Document 2 has a fixed toothed die capable of forming an unevenness-shaped pressed and deformed portion on a paper bundle and a movable toothed die capable of coming in contact with or separating from the fixed toothed die. Then, a paper bundle is bound by the fixed toothed die and the movable toothed die, of which a top surface of teeth has an end portion configured in a rounded shape.

CITATION LIST

Patent Document

Patent Document 1: International Publication No. WO 2014/208237

Patent Document 2: Japanese Patent Application Publication No. 2014-121865

SUMMARY OF INVENTION

Problems to be Solved

However, in the binder described in Patent Document 1, a region required for crimping (crimping surface) cannot be secured when attempting to bind a large number of sheets of paper. As a result, it is impossible to increase the number of sheets to be bound. In order to increase the number of sheets to be bound, it is necessary to secure a distance, which enables crimping by side surface portions of the pair of teeth with respect to a bonded thickness after binding. However, in the case of binding two sheets of paper, which correspond to the minimum number of sheets to be bound, the crimping distance is increased. Accordingly, in order to obtain a pressure as in a conventional case, it is necessary to increase a binding load to correspond to the crimping distance. Also, due to an increased load, there is a problem that when the number of sheets of paper is increased, tearing occurs in sheets of paper.

Further, in the paper processing apparatus described in Patent Document 2, the end portion or ridge of the binding teeth is formed in a rounded shape, thereby preventing tearing in sheets of paper. However, when attempting to bind a large number of sheets of paper, only forming the corner or ridge of the teeth into a rounded shape is insufficient as a measure against tearing in sheets of paper. Also, there is a problem that a binding strength is decreased.

Accordingly, the present invention has been made keeping in mind the above problems, and an object thereof is to provide a tooth portion, a binder, a paper processing apparatus and an image formation system, in which when crimp-binding a paper bundle using an increased binding load for the purpose of binding a large number of sheets of paper, it is possible to reliably prevent tearing in sheets of paper.

Means for Solving the Problems

The present invention can adopt, for example, the following configurations.

(1) A pair of tooth portions each having a plurality of convex portions and arranged to engage with each other when approaching each other, wherein the convex portion of at least one tooth portion of the pair of tooth portions has, on an opposing surface thereof opposing the convex portion of the other tooth portion, an abutting surface abutting against the convex portion of the other tooth portion when the pair of tooth portions is engaged with each other and a non-abutting surface not abutting against the convex portion of the other tooth portion when the pair of tooth portions is engaged with each other.

(2) The tooth portion according to the above (1), wherein the convex portion has an end surface configured as a surface which is bent from one end side of the opposing surface and which extends along a convex direction, wherein the non-abutting surface is provided between the abutting surface and the end surface.

(3) The tooth portion according to the above (1), wherein the convex portion has a top surface formed on one end side thereof in a convex direction, wherein the top surface has an inclined surface inclined toward the top.

(4) The tooth portion according to the above (1), wherein the plurality of convex portion of each of the pair of tooth portions are arranged to form in a row in a predetermined direction.

(5) The tooth portion according to the above (1), wherein the non-abutting surface of the convex portions of the one tooth portion is configured such that, when the pair of tooth portions is engaged with each other, a distance between the non-abutting surface of the convex portions of the one tooth portion and the non-abutting surface of the convex portions of the other tooth portion is increased toward the end surface.

(6) The tooth portion according to the above (4), wherein a longitudinal length of the opposing surface of the convex portions, which are arranged on both end portion of the plurality of convex portions forming in a row in the predetermined direction, is configured to be longer than a longitudinal length of the opposing surface of convex portions, which are arranged on a middle portion of the plurality of convex portions.

(7) The tooth portion according to the above (4), wherein each of the pair of tooth portions is provided by alternately arranging a plurality of convex portions with the opposing surfaces having different longitudinal lengths.

(8) A pair of tooth portions each having a plurality of convex portions and arranged to engage with each other when approaching each other, wherein the convex portion of at least one tooth portion of the pair of tooth portions has, on an opposing surface thereof opposing the respective convex portion of the other tooth portion, an abutting surface abutting against the convex portion of the other tooth portion when the pair of tooth portions is engaged with each other and a non-abutting surface not abutting against the convex portion of the other tooth portion when the pair of tooth portions is engaged with each other, wherein, when the pair of tooth portions is engaged with each other so that a normal length between the abutting surface of the opposing surface of the convex portion of the one tooth portion and the abutting surface of the opposing surface of the convex portion of the other tooth portion is 0.23 mm or greater and 0.35 mm or smaller, an opposing length, over which the abutting surface of the opposing surface of the convex portion of the one tooth portion and the abutting surface of the opposing surface of the convex portions of the other tooth portion oppose parallel to each other, is 0 mm or greater.

(9) A tooth portion configured to crimp and bind a paper bundle by engaging a pair of a first tooth and a second tooth, wherein the first tooth has a top surface portion, a front surface portion, a side surface portion, an inclined surface portion provided between the top surface portion and the front surface portion, and a third ridge portion provided between the inclined surface portion and the side surface portion, wherein the second tooth has a top surface portion, a front surface portion, a side surface portion, an inclined surface portion provided between the top surface portion and the front surface portion, and a third ridge portion provided between the inclined surface portion and the side surface portion, wherein assuming that, when the first tooth and the second tooth are engaged with each other with a predetermined gap interposed therebetween, a half of a length of a linear part of the inclined surface portion of the first tooth is A; a half of a length of a linear part of the inclined surface portion of the second tooth is B; a length of a common tangent part of the third ridge portion of the first tooth and the third ridge portion of the second tooth is C; a length from an intersection point between the third ridge portion of the first tooth and the linear part of the inclined surface portion of the first tooth to the common tangent part is D; a length from an intersection point between the third ridge portion of the second tooth and the linear part of the inclined surface portion of the second tooth to the common tangent part is E; a length between the center point of the linear part of the inclined surface portion of the first tooth and the center point of the linear part of the inclined surface portion of the second tooth is F; and an elongation rate is (A+B+C+D+E)/F, and assuming that when the first tooth and the second tooth are engaged with each other with a predetermined gap interposed therebetween, the elongation rates as measured at two different locations on the first tooth and the second tooth in a longitudinal direction thereof are X and Y respectively; a distance between the location of the elongation rate X and the location of the elongation rate Y is Z; and a rate of change in elongation rate is (Y−X)/Z, the rate of change in elongation rate is 0.4 or smaller.

(10) A binder comprising:

the tooth portion according to any one of the above (1) to (9); and a drive unit capable of driving the pair of tooth portions to be brought into contact with or separated from each other.

(11) A paper processing apparatus comprising:

a conveying unit configured to convey sheets of paper;

a stacking unit configured to stack sheets of paper conveyed by the conveying unit; and the binder according to the above (10) configured to bind a bundle of sheets of paper stacked by the stacking unit.

(12) The paper processing apparatus according to the above (11) comprising a position control unit configured to control a position of the binder relative to the bundle of sheets of paper, wherein the position control unit is configured to control the position of the binder in such a manner that the end surface faces the center side of the bundle of sheets of paper.

(13) An image formation system comprising:

an image formation apparatus configured to form an image on sheets of paper;

a conveying unit configured to convey the sheets of paper having the image formed by the image formation apparatus;

a stacking unit configured to stack sheets of paper conveyed by the conveying unit; and the binder according to the above (10) configured to bind a bundle of sheets of paper stacked on the stacking unit.

Advantageous Effects of Invention

According to the invention of the above (1), the opposing surfaces are provided with the non-abutting surface. As a result, it is possible to reduce a local elongation of sheets of paper when engaging a pair of teeth with each other to bind a bundle of sheets of paper, thereby preventing tearing in sheets of paper.

According to the invention of the above (3), the inclined surface is further formed, thereby further reducing the local elongation of sheets of paper and thus preventing tearing in sheets of paper.

According to the invention of the above (8), a compressive contact distance is set to 0 mm or greater when a side surface separation distance is 0.23 mm or greater and 0.35 mm or smaller. Accordingly, even when a large number of sheets of paper is bound, it is possible to prevent tearing in sheets of paper when engaging the first tooth and the second tooth, which make a pair, to crimp a bundle of sheets of paper.

According to the invention of the above (9), the rate of change in elongation rate is set to 0.4 or smaller, thereby reducing a local elongation of sheets of paper when engaging the first tooth and the second tooth, which make a pair, to crimp a bundle of sheets of paper. As a result, it is possible to prevent tearing in sheets of paper.

BRIEF DESCRIPTION OF DRAWINGS

FIGS. 3A and 3B are views explaining an exemplary operation of the post-processing apparatus when performing a binding processing, wherein FIG. 3A is a plan view of the post-processing apparatus and FIG. 3B is a side view thereof.

FIGS. 4A and 4B are views explaining an exemplary operation of the post-processing apparatus when performing the binding processing, wherein FIG. 4A is a plan view of the post-processing apparatus and FIG. 4B is a side view thereof.

FIGS. 5A and 5B are views explaining an exemplary operation of the post-processing apparatus when performing the binding processing, wherein FIG. 5A is a plan view of the post-processing apparatus and FIG. 5B is a side view thereof.

FIGS. 6A and 6B are views explaining an exemplary operation of the post-processing apparatus when performing the binding processing, wherein FIG. 6A is a plan view of the post-processing apparatus and FIG. 6B is a side view thereof.

FIGS. 7A and 7B are views explaining an exemplary operation of the post-processing apparatus when performing the binding processing, wherein FIG. 7A is a plan view of the post-processing apparatus and FIG. 7B is a side view thereof.

FIG. 25 is a view explaining a side surface separation distance and a compressive contact distance.

FIG. 26 is a view showing a verification result of a retention force at a bound portion of a paper bundle in cases of using a plurality of types of binding teeth and also varying a distance between lower tooth and upper tooth of each of types of binding teeth and varying the side surface separation distance to cause the compressive contact distance to become 0 mm.

FIGS. 29A to 29D are views showing an elongation rate at each of cross-sections of the binding teeth shown in FIG. 28, wherein FIG. 29A is a sectional view taken along a line w-w, FIG. 29B is a sectional view taken along a line x-x, FIG. 29C is a sectional view taken along a line y-y, and FIG. 29D is a sectional view taken along a line z-z.

FIG. 30A is a graph showing a rate of change in elongation rate in cases of using a plurality of types of binding teeth, and FIG. 30B shows shapes of the binding teeth used in FIG. 30A and also a verification result on tearing in a bound booklet when binding of a paper bundle has been performed using the binding teeth.

DETAILED DESCRIPTION OF PREFERRED EMBODIMENTS

Figure 1:
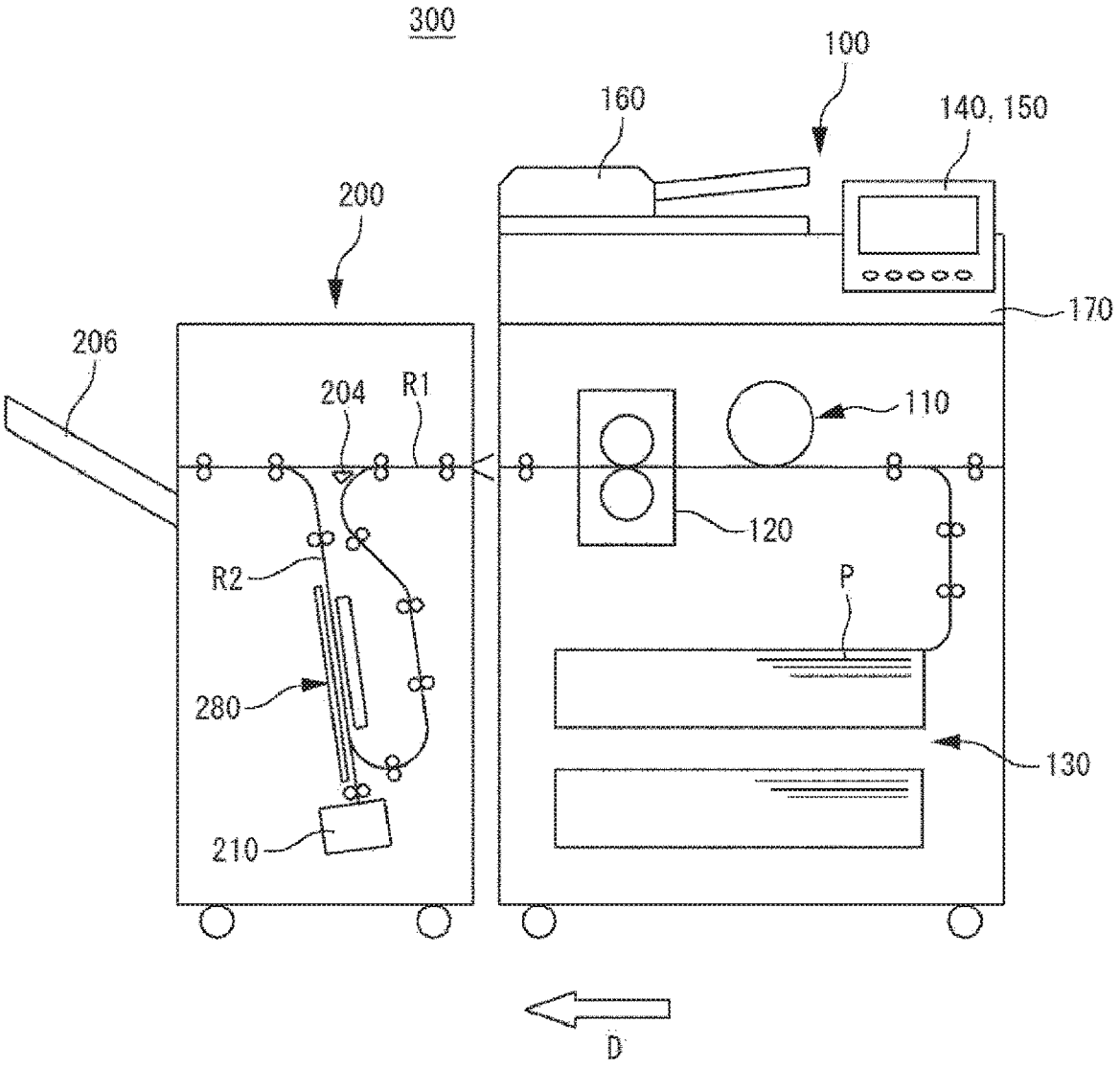
FIG. 1 is a view showing an exemplary configuration of an image formation system according to one embodiment of the present invention.

Hereinafter, preferable embodiments of the present invention will be described in detail with reference to the accompanying drawings. Meanwhile, dimension ratios in the drawings are expanded for convenience of explanation and thus may differ from actual ratios.

[Exemplary Configuration of Image Formation System 300]

FIG. 1 shows an example of a configuration of an image formation system 300. As shown in FIG. 1, the image formation system 300 includes an image formation apparatus 100 for forming an image on a sheet of paper and a post-processing apparatus 200 for performing crimping, binding and the like on a bundle of sheets of paper with the image formed thereon. Meanwhile, the post-processing apparatus 200 constitutes an example of a paper processing apparatus.

The image formation apparatus 100 has a document conveying unit 160, an image reading unit 170, a paper feeding unit 130, an image forming unit 110, a fixing unit 120, a display unit 140 and an input unit 150.

The document conveying unit 160 is configured to convey a document sheet, which is set on a conveying tray, to a glass table. The image reading unit 170 is configured to produce an image data by scanning a document set on the glass table or a document fed by the document conveying unit 160 with a laser beam and then reading the document with a photoelectric conversion element. The paper feeding unit 130 has a plurality of stages of paper feeding trays for receiving sheets of paper P of a size, such as A4 or A3 and is configured to take out and convey a sheet of paper P of a predetermined paper type therefrom to the image forming unit 110 as a printing job is started.

The image forming unit 110 is configured to form a predetermined toner image by charging, exposing and developing a surface of a photosensitive drum based on the image data inputted thereto and then to transfer the image to a surface of the sheet of paper P fed from the paper feeding unit 130. Meanwhile, as the image forming unit 110, a configuration capable of forming only a monochrome image may be employed or a configuration capable of forming a color image may be employed.

The fixing unit 120 is configured to fix the image to the sheet of paper P by pressing and heating the sheet of paper P having the image transferred thereto by the image forming unit 110. Sheets of paper P subjected to the fixing processing by the fixing unit 120 are successively conveyed to the post-processing apparatus 200 through an output port. Also, in the case of double-sided printing, the front and back of the sheet of paper P is reversed via a paper reversing path (not shown) and then an image is transferred to the back surface of the sheet of paper P. Thereafter, the sheet of paper P is conveyed to the post-processing apparatus 200 through the output port.

The display unit 140 and the input unit 150 can be constructed by a touch panel, operation buttons provided on the periphery thereof and the like. The display unit 140 and the input unit 150 are configured to input settings on image forming conditions, such as paper size and the number of sheets to be printed, as well as settings on post-processing conditions, such as whether binding is crimp-binding, which uses crimping by means of binding teeth, or stable binding, which uses staples, the number of sheets to be bound and binding positions, with an operation screen or operation button.

Figure 2A:
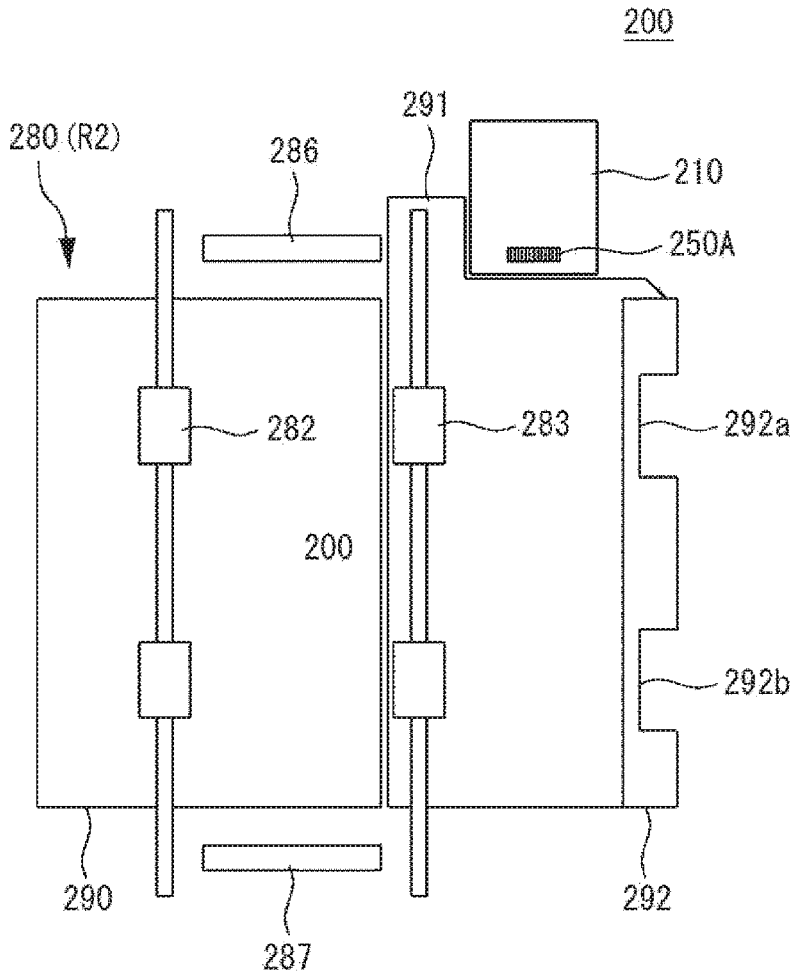
FIG. 2A is a plan view of a post-processing apparatus and FIG. 2B is a side view thereof.
Figure 2B:
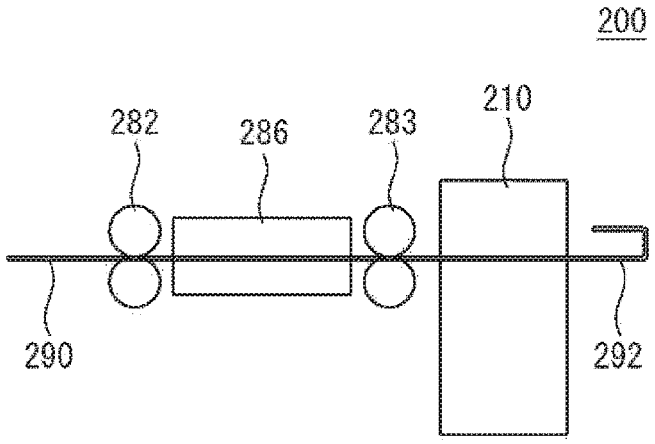

FIG. 2A is a plan view of the post-processing apparatus 200 and FIG. 2B is a side view thereof. Meanwhile, in FIGS. 2A and 2B, the right side of the paper corresponds to the lower side of the post-processing apparatus 200 and the left side of the paper corresponds to the upper side of the post-processing apparatus 200.

As shown in FIGS. 1 and 2, the post-processing apparatus 200 is connected to a downstream side of the image formation apparatus 100 in a paper conveying direction D and is configured to produce a booklet by performing a crimp-binding or staple-binding on a bundle of sheets of paper P having an image formed in the image formation apparatus 100. Meanwhile, in the following, the detailed description of the staple-binding will be omitted since known techniques can be employed for the staple-binding.

The post-processing apparatus 200 has conveyance paths R1, R2, a conveyance path switching unit 204, a binding device 210, and a paper stacking unit 280.

The conveyance path R1 is a path intended to convey sheets of paper P in the case where a binding processing, such as crimp-binding, is not performed thereon, and is configured to horizontally extend from an input port to an output port. The conveyance path R2 is a path intended to convey sheets of paper P in the case where a binding processing, such as crimp-binding, is performed thereon, and is configured to branch off from the conveyance path R1, to extend in a U-shape and then to join with the conveyance path R1 downstream of the branching point.

The conveyance path switching unit 204 is arranged at the branching point of the conveyance paths R1, R2 and is configured to switch the conveyance paths based on whether or not a binding processing such as crimping is performed. In the conveyance path switching unit 204, for example, a solenoid can be employed.

The paper stacking unit 280 has conveying rollers 282, 283, side joggers 286, 287, a paper stacking table 290, a guide member 291 and an end wall 292. The paper stacking unit 280 is provided on a conveyance path of the conveyance path R2, which extends upward from the lower side thereof.

The conveying rollers 282, 283 are provided to be rotatable in forward and reverse directions and thus to convey a sheet of paper P, which has been conveyed to the conveyance path R2, in a switch-back manner to allow the sheet of paper P to be received in the paper stacking unit 280 or to convey a booklet, on which a binding processing is completed, from the paper stacking unit 280 onto a paper discharge tray 206. Meanwhile, a technique of discharging the booklet onto the paper discharge tray 206 is not limited to the technique of using the conveying rollers 282, 283, and accordingly the booklet may be discharged onto the paper discharge tray 206 by conveying the booklet while holding the booklet by a conveyance means having claw portions.

The side joggers 286, 287 are provided between the conveying rollers 282, 283 and also at positions corresponding respectively to side portions of a sheet of paper P (on both sides of the conveyance path R2). The side joggers 286, 287 are configured to be movable in a paper width direction, thereby aligning side positions of sheets of paper P stacked on the paper stacking unit 280.

On the paper stacking table 290, sheets of paper P conveyed to the paper stacking unit 280 are successively staked. The guide member 291 is formed in a generally L-shape to extend from front of a binding position of the binding device 210 along a side surface thereof and thus is configured to guide a paper bundle stacked on the paper stacking table 290 up to the binding position. Thus, it is possible to convey the paper bundle up to the binding position while preventing the paper bundle from being caught in a gap of the binding device 210 or on binding teeth 250A.

The end wall 292 is formed to have a lateral shape of a generally U-shape and is arranged below the paper stacking table 290, thereby aligning and supporting front end portions (lower end portions) of sheets of paper P conveyed on the paper stacking unit 280. The end wall 292 is provided to be movable along a paper conveying direction of the conveyance path R2 and thus configured to move between a home position (initial position) and the binding position. Meanwhile, although in the present embodiment, the end wall 292 and the guide member 291 are integrally formed with each other, they may be formed as separate bodies. Two notch portions 292*a*, 292*b* are formed on a lower end portion of the end wall 292. An electric stapler (not shown) can be arranged on the notch portions 292, 292*b*. The electric stapler may be configured to move between the notch portions 292*a*, 292*b* and thus to bind a paper bundle at one or two locations thereon by changing a binding position relative to the paper bundle.

The binding device 210 is provided on the paper stacking unit 280 and is configured to bind a paper bundle stacked on the paper stacking table 290 by crimping the paper bundle with a pair of binding teeth 250A. Although an example in which the binding device 210 is fixedly installed will be described in the present embodiment, the binding device 210 may be configured to be movable so that a binding position can be changed. At this time, the binding device 210 may be configured to move between the above notch portions 292*a*, 292*b*. Meanwhile, the configuration or operation of the binding device 210 will be described below.

[Exemplary Operation of Post-Processing Apparatus 200]

FIGS. 3 to 7 are views explaining an example of operation of the post-processing apparatus 210 when performing a binding processing. FIGS. 3A, 4A, 5A, 6A and 7A are plan views of the post-processing apparatus 200 and FIGS. 3B, 4B, 5B, 6B and 7B are side views thereof. Meanwhile, in FIGS. 5 to 7, it is assumed that a paper bundle is a stack of two or more sheets of paper P. Meanwhile, in FIGS. 3 to 7, the right side of the paper corresponds to the lower side of the post-processing apparatus 200 and the left side of the paper corresponds to the upper side of the post-processing apparatus 200.

Figure 3A:
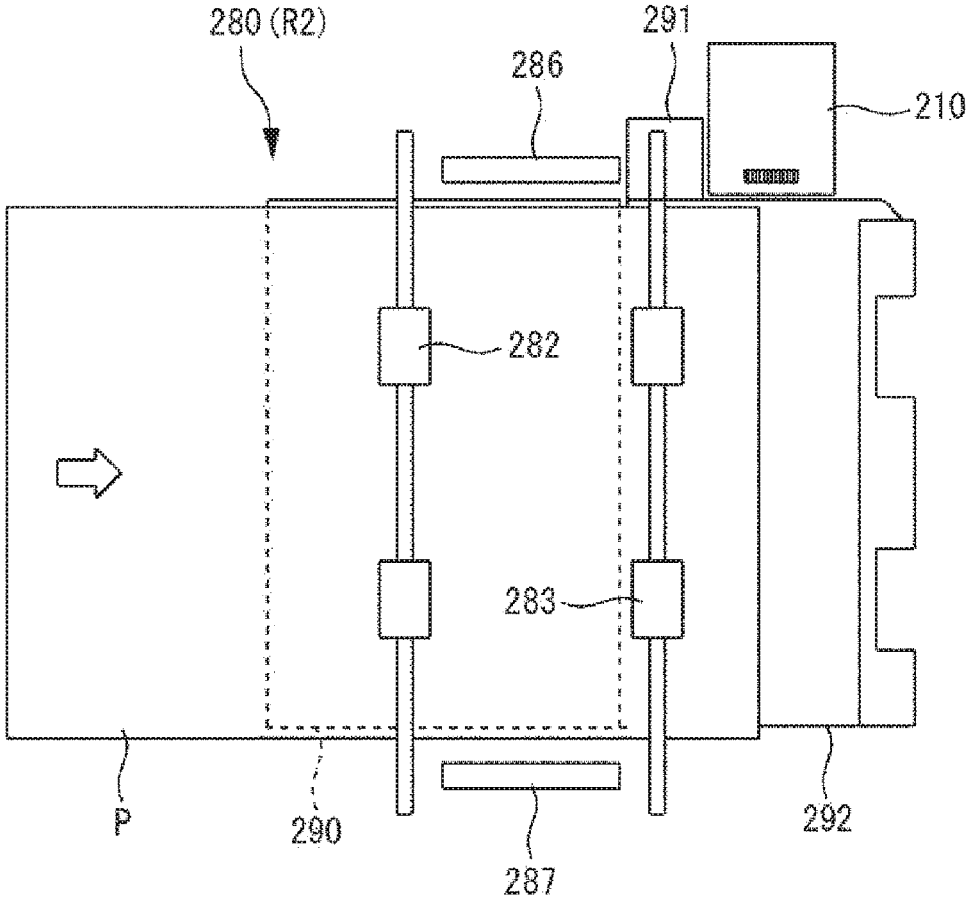
Figure 3B:
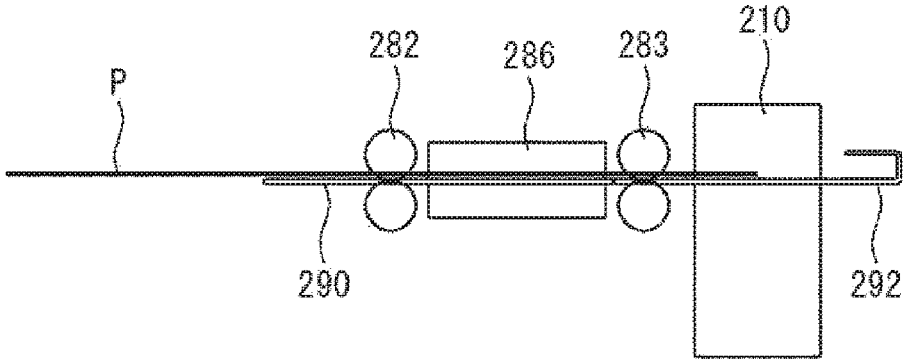

Sheets of paper P having an image formed in the image formation apparatus 100 are conveyed into the conveyance path R2 of the post-processing apparatus 200. As shown in FIGS. 3A and 3B, the sheets of paper P conveyed to the conveyance path R2 are conveyed in a switch-back manner by the conveying rollers 282, 283 and then are successively stacked on the paper stacking table 290.

Figure 4A:
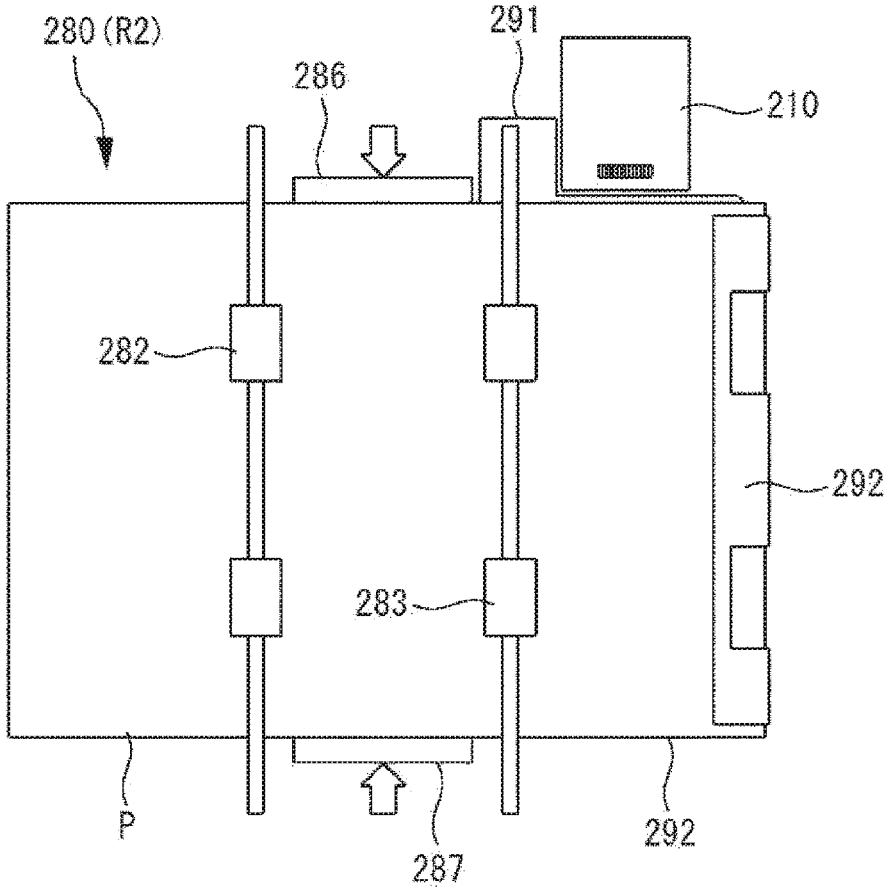
Figure 4B:
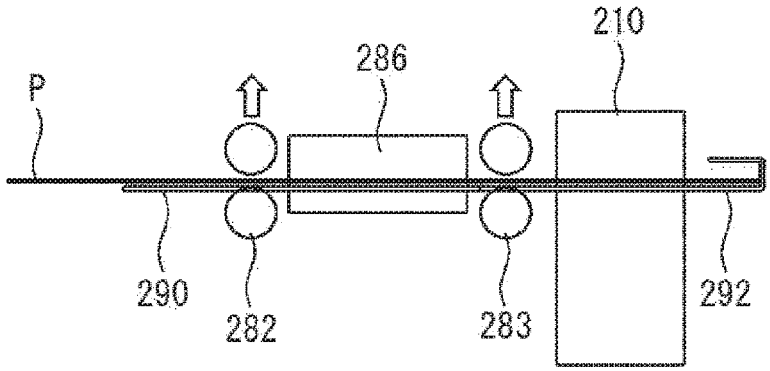

Subsequently, as shown in FIGS. 4A and 4B, once the sheets of paper P are stacked on the paper stacking table 290, an abutted state of the rollers 282, 283 against the sheets of paper P is released and also rotation thereof is stopped. Subsequently, each of the side joggers 286, 287 moves inward, thereby aligning side positions of the sheets of paper P. Meanwhile, an operation of aligning side positions of sheets of paper P may be performed on every one sheet of paper or every plurality of sheets. Further, in the case where one end side of the sheets of paper P is used as the side position, only one of the side joggers 286, 287 may be moved.

Figure 5A:
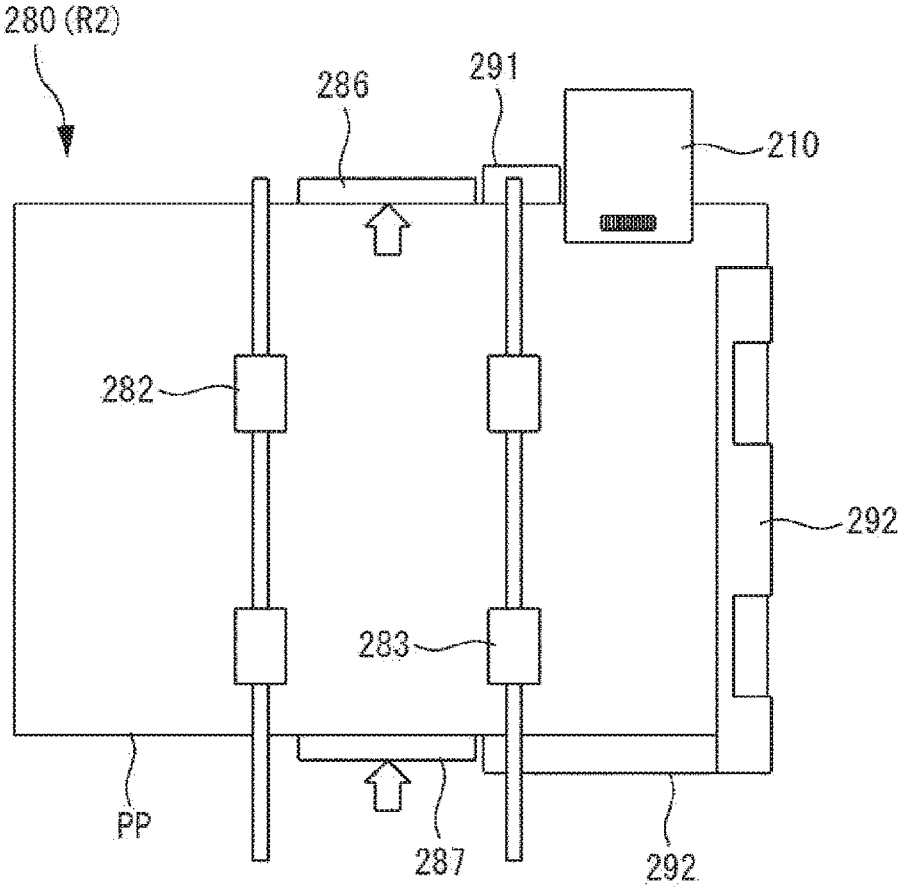
Figure 5B:
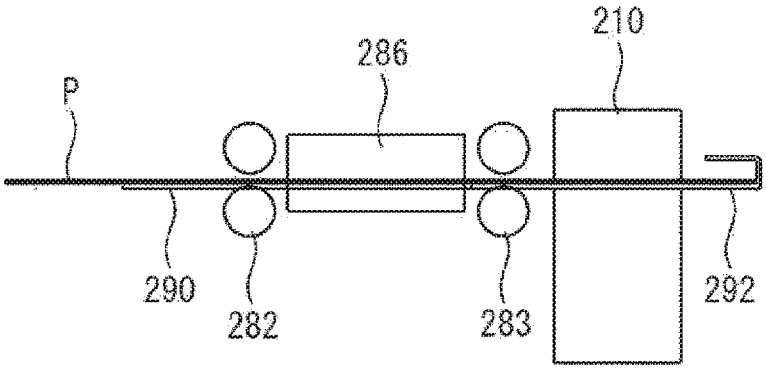

Subsequently, as shown in FIGS. 5A and 5B, once side surfaces of a predetermined number of sheets of paper P are completely aligned, the side joggers 286, 286 move toward the binding device 210 in the paper width direction while sandwiching side surface portions of a paper bundle PP therebetween. That is, the paper bundle is moved to a binding position by the side joggers 286, 287 and thus the binding position in the paper width direction is aligned.

Figure 6A:
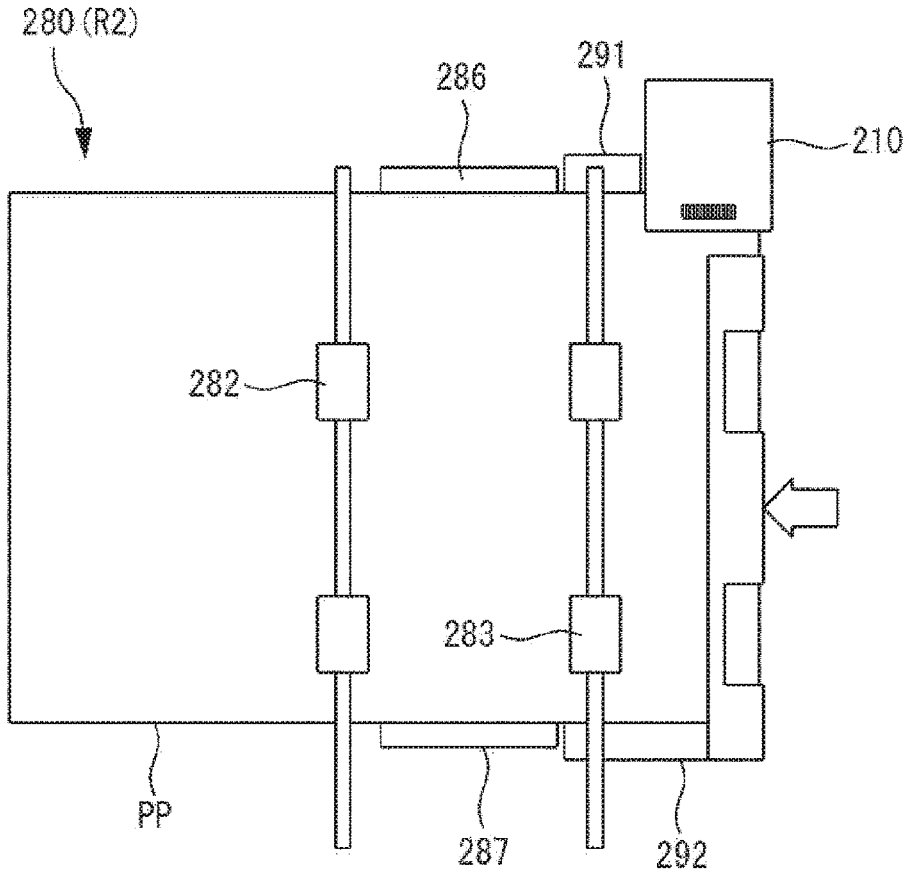
Figure 6B:
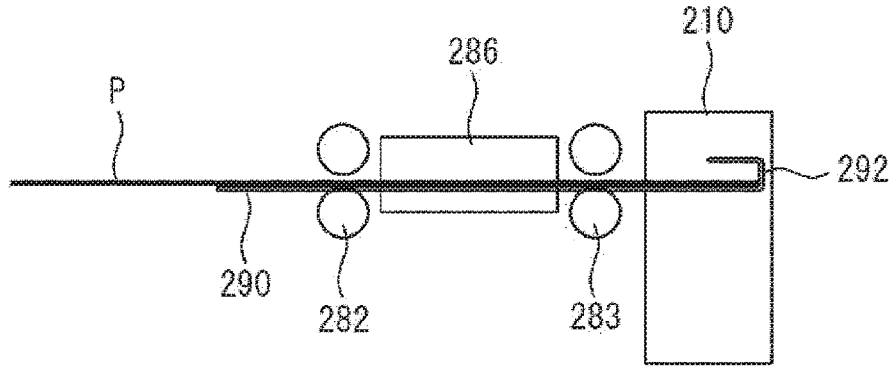

Subsequently, as shown in FIGS. 6A and 6B, once movement by the side joggers 286, 287 is ended, the end wall 292 moves upward. That is, the paper bundle is moved to the binding position by the end wall 292 and thus the binding position in the paper conveying direction is aligned. Thus, the paper bundle PP is set at the binding position predetermined by a user and then a binding processing is performed on the paper bundle by the binding device 210. Meanwhile, although in the foregoing embodiment, the paper bundle PP is moved to the binding position after the paper bundle PP is formed, every one sheet of paper P may be directly moved to the binding position.

Figure 7A:
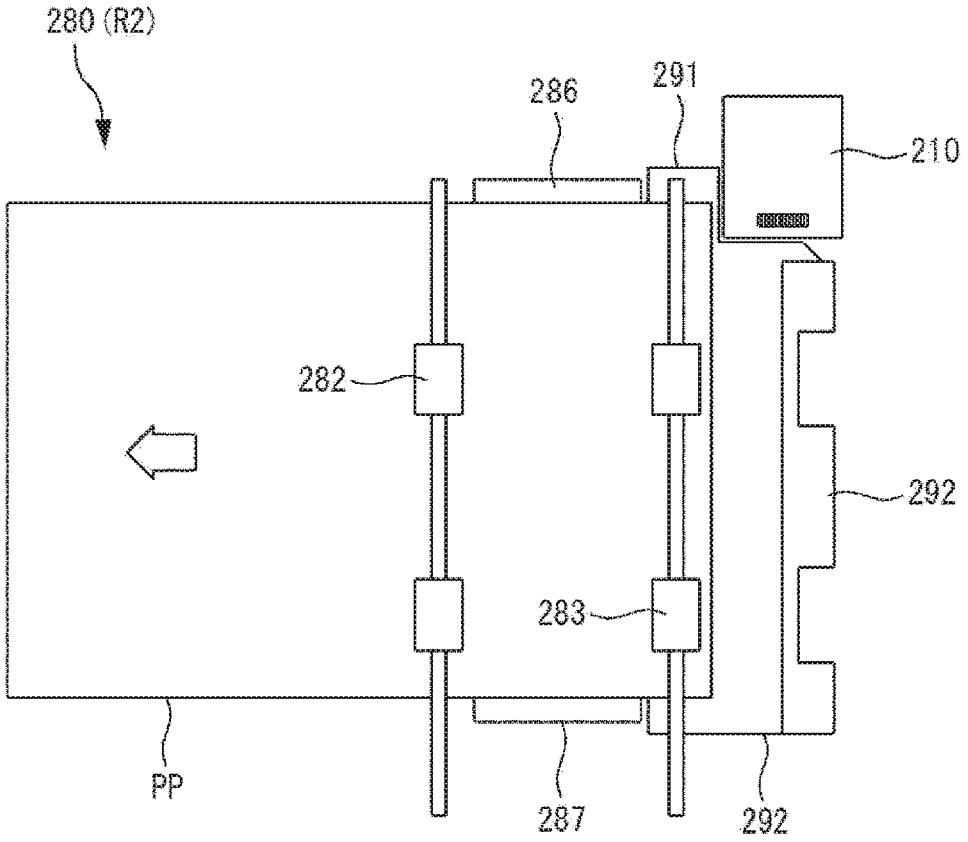
Figure 7B:
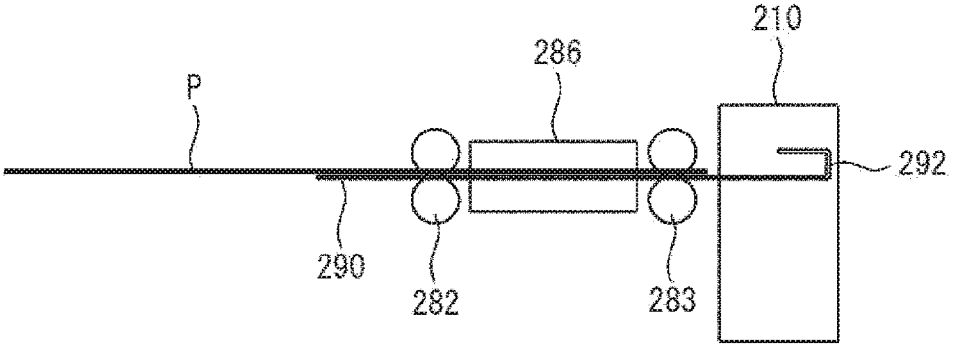

Subsequently, as shown in FIGS. 7A and 7B, once the binding processing is ended, the conveying rollers 282, 283 abut against the sheets of paper P and also are rotationally driven. As a result, the paper bundle PP subjected to the binding processing is conveyed from the paper stacking table 290 and thus discharged onto the paper discharge tray 206 via paper discharging rollers.

[Exemplary Configuration of Binding Device 210]

Figure 8:
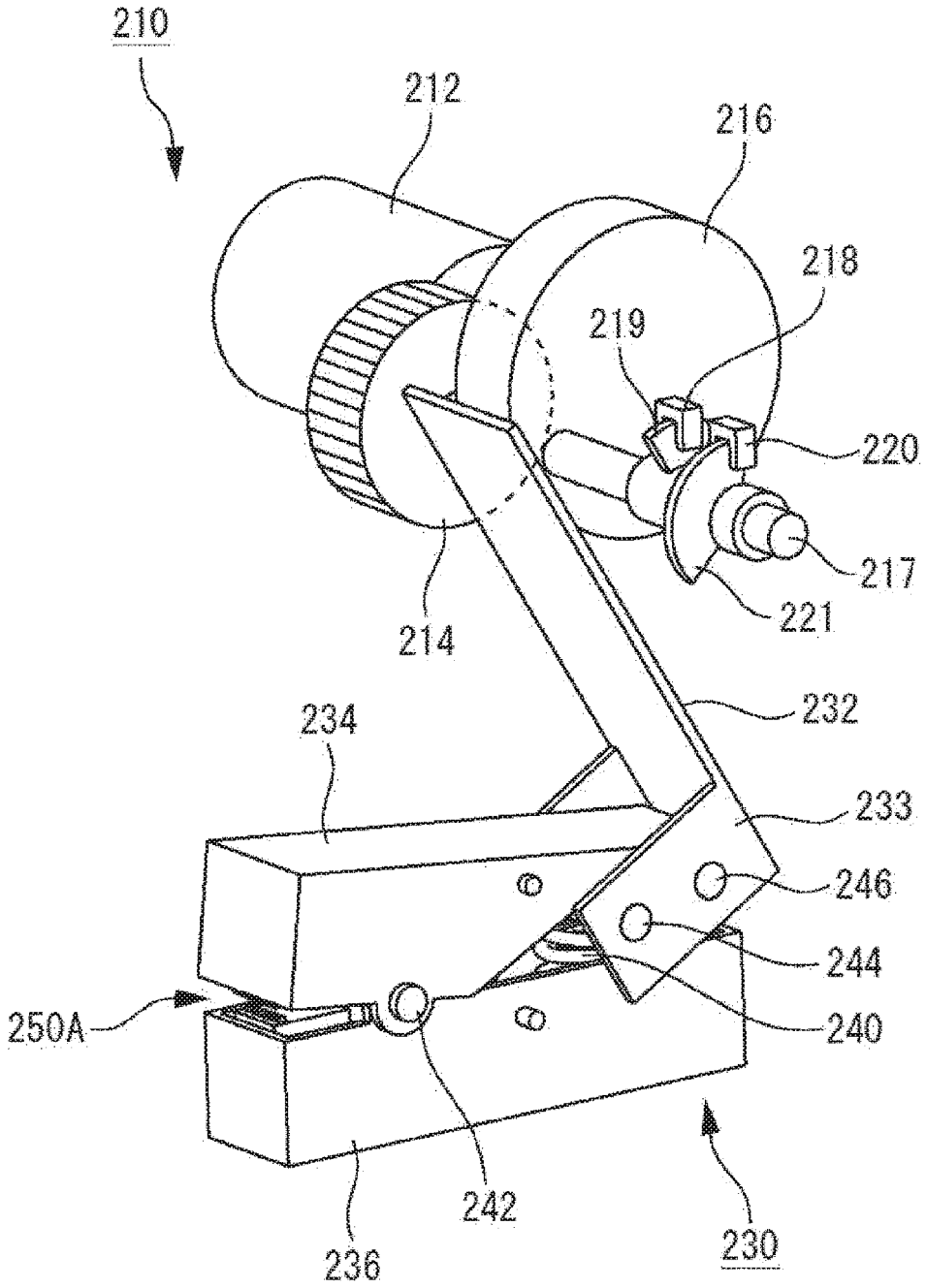
FIG. 8 is a perspective view showing an exemplary configuration of a binding device.
Figure 9:
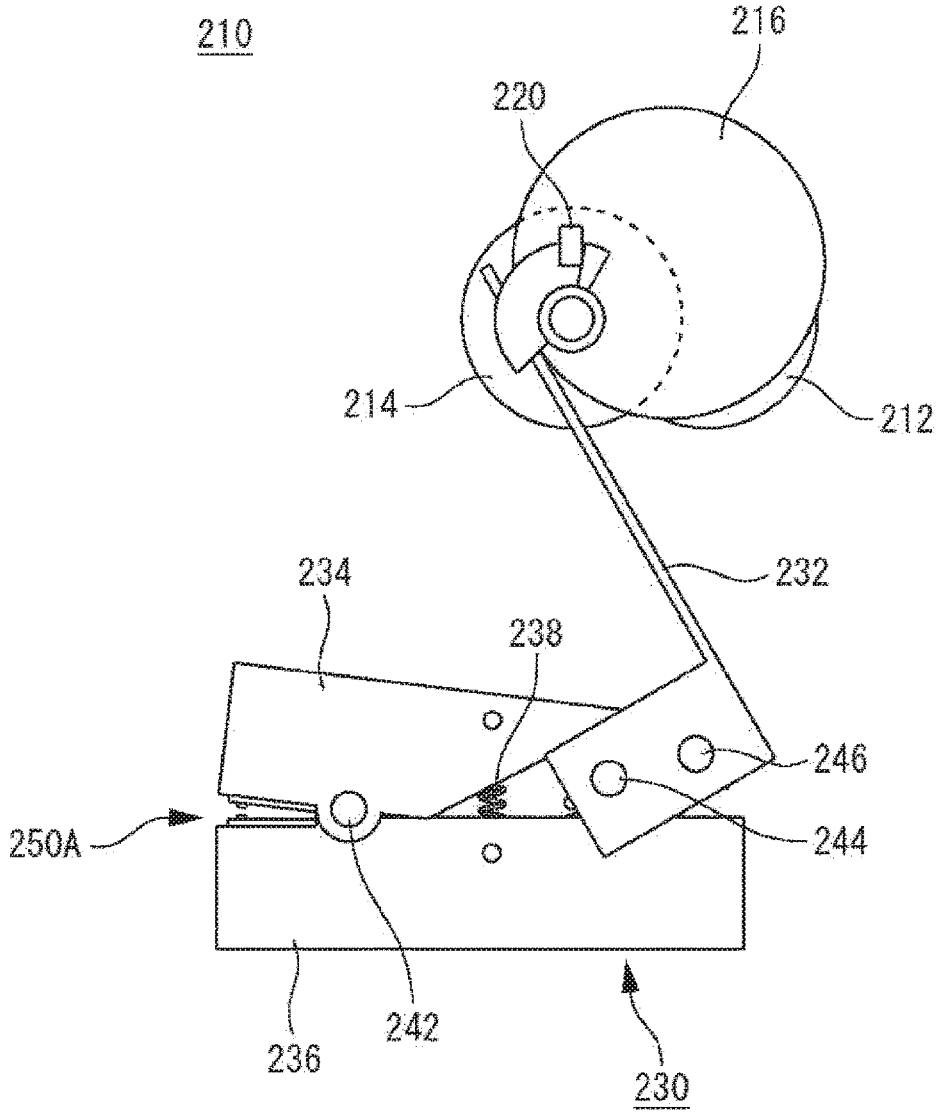
FIG. 9 is a side view showing the exemplary configuration of the binding device.
Figure 10:
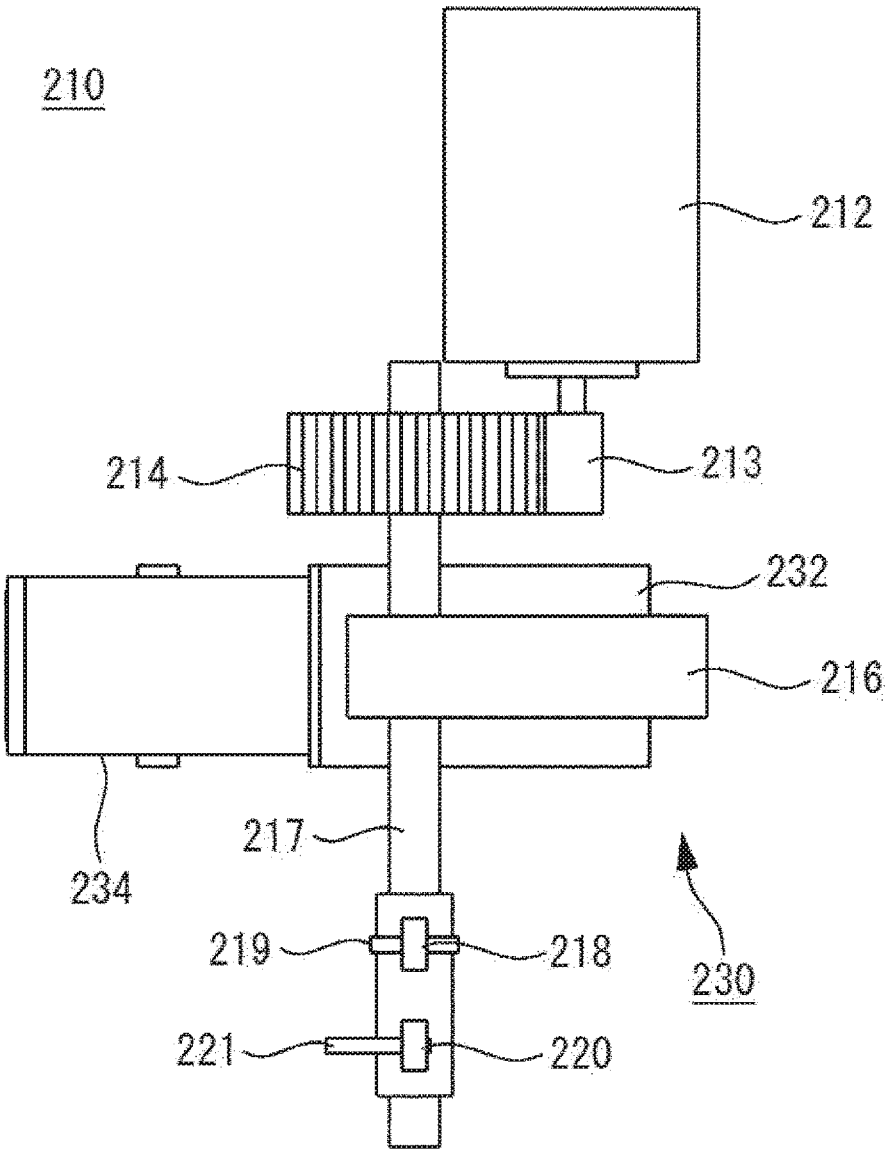
FIG. 10 is a plan view showing the exemplary configuration of the binding device.
Figure 11:
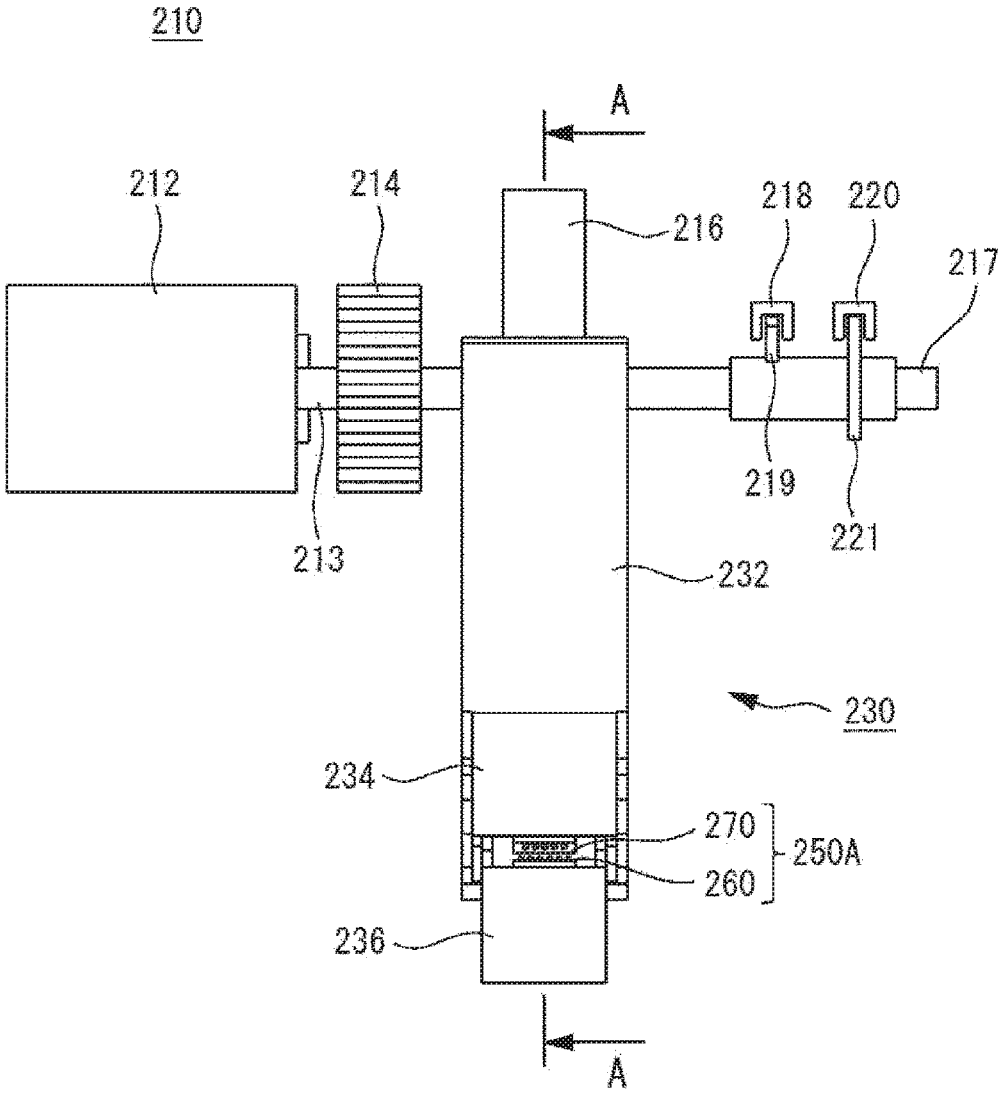
FIG. 11 is a front view showing the exemplary configuration of the binding device.
Figure 12A:
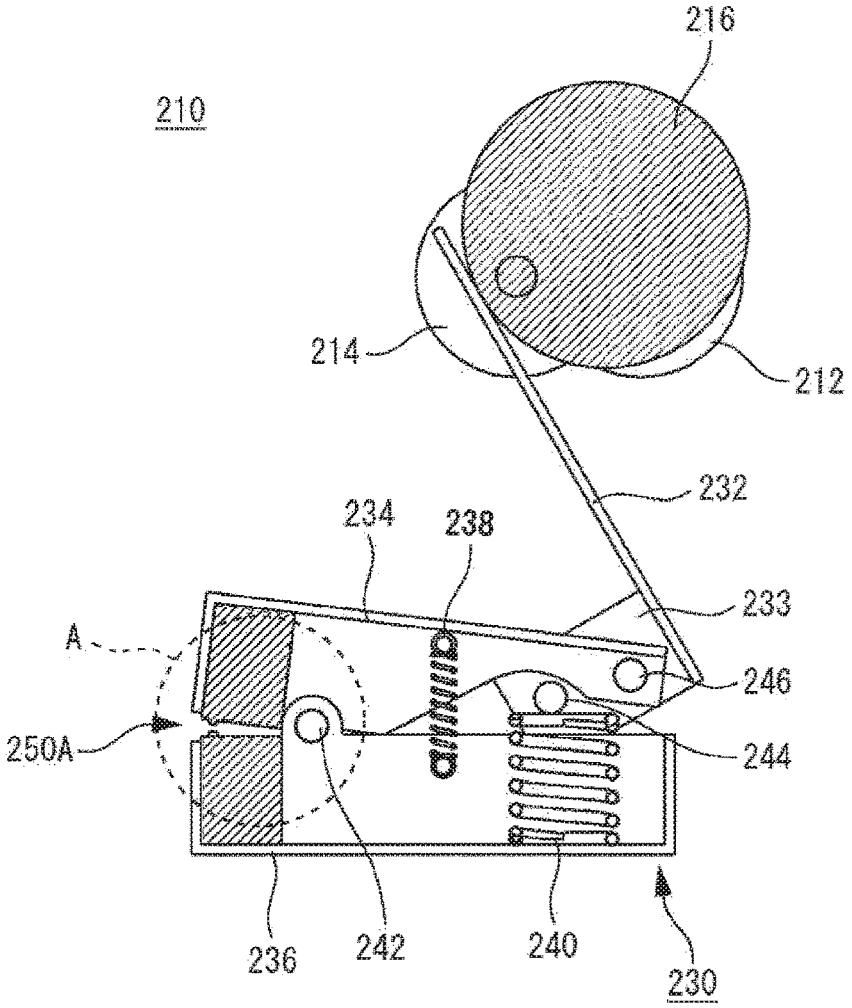
FIG. 12A is a sectional view taken along a line A-A in FIG. 11
Figure 12B:
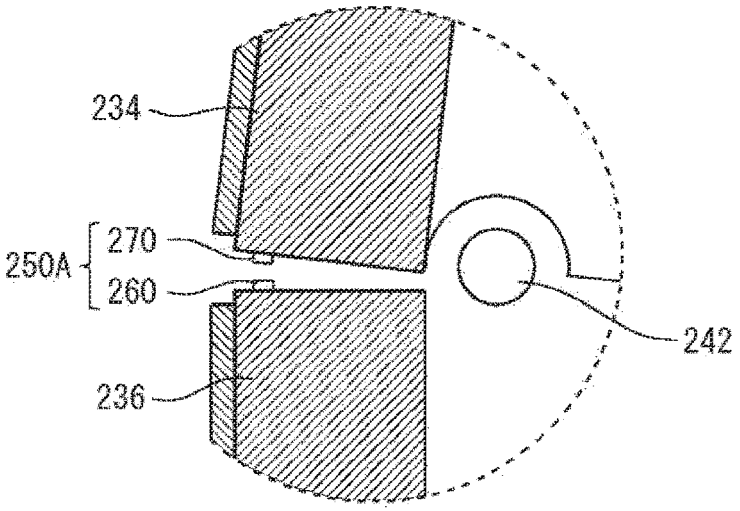
FIG. 12B is an enlarged view of a main part A in FIG. 12A.

FIG. 8 is a perspective view showing an example of a configuration of the binding device 210, FIG. 9 is a side view thereof, FIG. 10 is a plan view thereof and FIG. 11 is a front view thereof. FIG. 12A is a sectional view taken along a line A-A in FIG. 11 and FIG. 12B is an enlarged view of a main part A in FIG. 12A. Meanwhile, in FIGS. 8 to 12, a side, on which the binding teeth 250A are provided, is referred to as a front end side and a side opposite thereto is referred to as a rear end side.

As shown in FIGS. 8 to 12, the binding device 210, which is equipped with an example of a drive unit, includes a driving motor 212, an eccentric cam 216, a home position sensor (hereinafter, referred to as a HP sensor) 218, a timing sensor 220 and a binder 230. Meanwhile, the drive unit is not limited to that as described in the present embodiment.

The driving motor 212 is constructed, for example, by a DC motor, a stepping motor or the like and configured to be rotationally driven based on a binding instruction.

The eccentric cam 216 is a disk cam and is configured to be connected to a motor gear 213 of the driving motor 212 via a gear 214 and thus to be eccentrically rotated in accordance with rotation of the driving motor 212. Meanwhile, the eccentric cam 216 may be controlled to return to a home position thereof by one revolution thereof or to return to the home position, for example, by rotating the eccentric cam 216 in a reverse direction after rotating the eccentric cam 216 up to a maximum load position thereof.

A driving shaft 217 protrudes from a face of the eccentric cam 216 opposite to the driving motor 212. On the driving shaft 217, a detected member 219 for the HP sensor and a detected member 221 for the timing sensor, which have a circular sector shape, are attached in this order from the eccentric cam 216. As an example, the detected member 221 is formed to have a central angle larger than that of the detected member 219 and equal to or less than 180° in order to detect a rotational position of the eccentric cam 216 by an interval of 180°.

The HP sensor 218 is constructed by, for example, an optical sensor of a transmission type or reflection type and is arranged in the vicinity of the detected member 219. The HP sensor 218 is configured to detect whether or not the eccentric cam 216 is positioned at the home position based on the presence of the detected member 219. The timing sensor 220 is constructed by, for example, an optical sensor of a transmission type or reflection type and is arranged in the vicinity of the detected member 221. The timing sensor 220 is configured to detect a rotational position of the eccentric cam 216 based on the presence of the detected member 221.

The binder 230 has a pressing lever 232, an upper arm 234, a lower arm 236, a return spring 238, an elastic member 240 and the binding teeth 250A. Meanwhile, the upper arm 234 and the lower arm 236 constitute the example of the drive unit.

The pressing lever 232 is an elongated flat plate member, and an outer surface of one end side thereof abuts against a peripheral surface of the eccentric cam 216. On the other end portion of the pressing lever 232, protrusions 233, 233 are provided to extend from respective side surfaces thereof in a direction perpendicular to a longitudinal direction of the pressing lever 232. The protrusions 233, 233 are fitted to a rear end portion of the upper arm 234 from the outside and are pivotally attached on the upper arm 234 via a lever fulcrum portion 246, which is formed as a shaft member.

The upper arm 234 has a shape of an elongated rectangular parallelepiped body, of which lower side is opened.

The lower arm 236 has a shape of an elongated rectangular parallelepiped body, of which upper side is opened, and is arranged to oppose the upper arm 234. The upper arm 234 and the lower arm 236 are configured to be pivotable relative to each other about an arm fulcrum portion 242, which is formed as a shaft member, at locations thereon, which are located slightly toward distal end side thereof rather than the middle portion.

Figure 13:
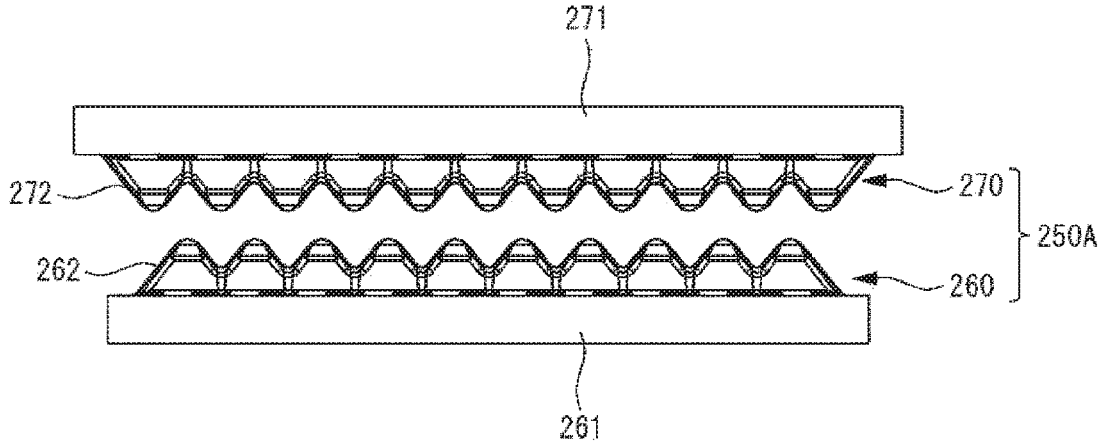
FIG. 13 is a view showing an exemplary configuration of binding teeth.

FIG. 13 shows an example of a configuration of the binding teeth 250A as an example of a pair of tooth portions having a plurality of convex portions. As shown in FIGS. 12B and 13, the binding teeth 250A are constituted of a pair of a lower tooth 260 and an upper tooth 270. The lower tooth 260 is removably attached to a front end portion of the lower arm 236, and the upper tooth 270 is removably attached to a front end portion of the upper arm 234. The lower tooth 260 and the upper tooth 270 are configured to crimp and bind a paper bundle by engaging with each other while the paper bundle is interposed therebetween. The lower tooth 260 is an example in which a plurality of tooth portions 262 as a plurality of convex portions are arranged side by side. The upper tooth 270 is an example in which a plurality of tooth portions 272 as a plurality of convex portions are arranged side by side. As an example of a pair of tooth portions, the lower tooth may be provided with a single tooth portion 262 and the upper tooth may be provided with a single tooth portion 272. As another example of a pair of toots portions, one of the lower tooth and the upper tooth may be provided with a single tooth portion 262 and the other may be provided with a plurality of tooth portions 262. Meanwhile, the binding teeth 250A will be described below.

Returning to FIGS. 8 to 12, the return spring 238 is constructed by, for example, a tension spring or the like and is configured such that one end portion thereof is attached on an inner side of the substantially middle portion of the upper arm 234 and the other end portion is attached on an inner side of the substantially middle portion of the lower arm 236. In a state where no load is exerted on the pressing lever 232, the front end portion of the upper arm 234 and the front end portion of the lower arm 236 are kept separated from each other due to urging by the return spring 238.

The elastic member 240 is constructed by, for example, a compressive spring and is configured to be attached on an inner side of a rear end portion of the lower arm 236. A pressing member 244 is constructed by a shaft member and is configured to be attached and bridged between the protrusions 233, 233 and also to be elastically supported by an upper end portion of the elastic member 230 at an outer peripheral surface thereof. As the pressing lever 232 is pivoted, the pressing member 244 moves toward a rear part side while pressing the elastic member 240, thereby moving the lever fulcrum portion 246 in a direction separating from the upper arm 234. Meanwhile, the elastic member 240 may be constructed by, for example, a leaf spring, rubber, resin material or the like.

[Exemplary Operation of Binding Device 210]

Figure 14A:
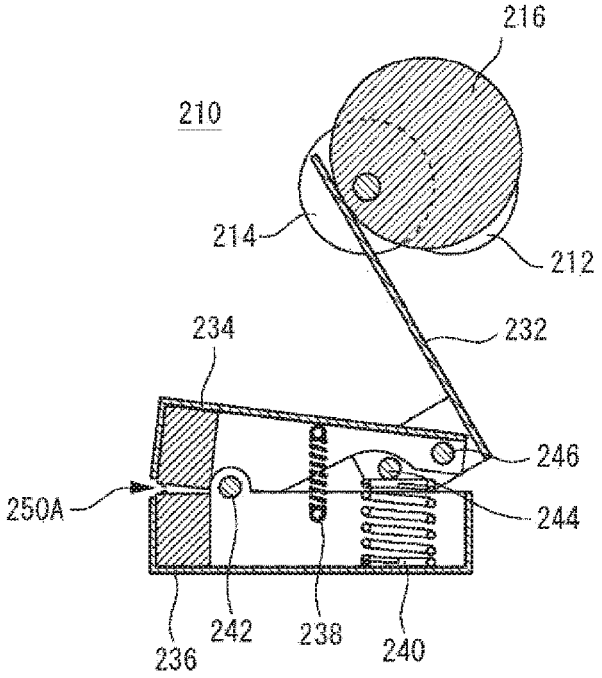
FIGS. 14A to 14C are views showing an exemplary operation of the binding device when performing a crimp-binding processing.
Figure 14B:
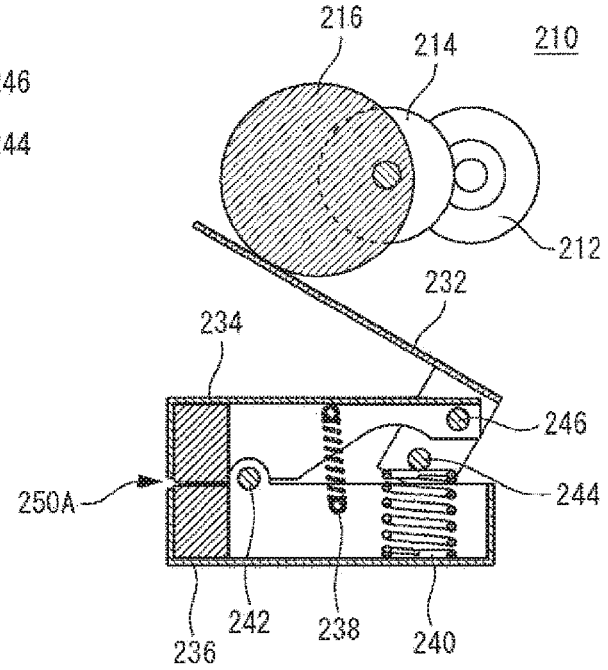
Figure 14C:
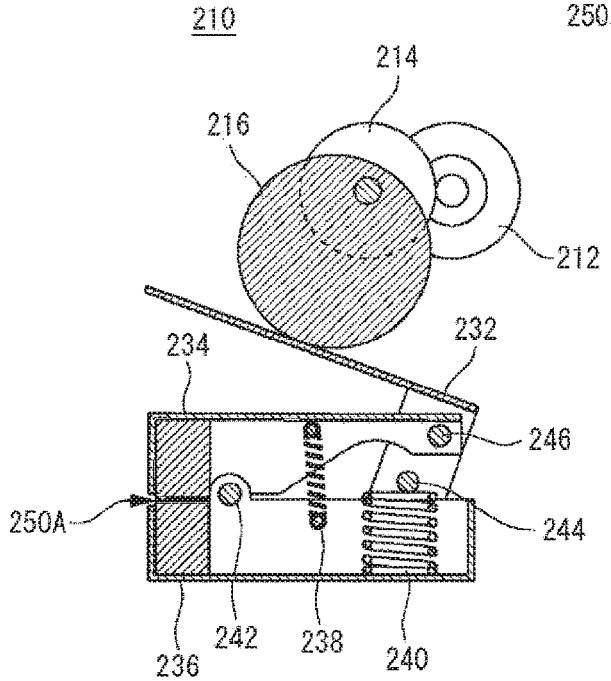

FIGS. 14A to 14C are views showing an example of an operation of the binding device when performing a crimp-binding processing. As shown in FIG. 14A, the eccentric cam 216 is positioned at the home position until a binding instruction is received, and thus the binding teeth 250A provided on the front end portion of each of the upper arm 234 and the lower arm 236 is kept separated from each other.

As shown in FIG. 14B, if the binding instruction is received, the eccentric cam 216 is rotated by rotation of the driving motor 212, thereby pressing one end portion side of the pressing lever 232 is pressed and thus causing the pressing lever 232 to be moved in a direction approaching the upper arm 234. The pressing member 244 moves toward the rear part side while pressing the elastic member 240 by a load exerted thereon, thereby moving the lever fulcrum portion 246 of the pressing lever 232 in a direction separating from the lower arm 236. At the same time, the rear end portion side of the upper arm 234 is pushed upward, so that the front end portion side of the upper arm 234 moves toward the lower arm 236 about the arm fulcrum portion 242, thereby engaging the upper tooth 270 with the lower tooth 260.

As shown in FIG. 14C, in order to cause engagement between the upper tooth 270 and the lower tooth 260 to become a maximum load state, the eccentric cam 216 is further rotated by rotation of the driving motor 212, so that the pressing lever 232 is further moved in the direction approaching the upper arm 234. At the same time, the pressing member 244 moves toward the rear part side while pressing the elastic member 240 by the maximum load exerted thereon. Therefore, the rear end portion of the upper arm 234 is slightly pushed upward, and as a result, engagement between the lower tooth 260 and the upper tooth 270 becomes the maximum load state. Also, the elastic member 240 shrinks due to the maximum load from the pressing member 244, thereby relieving a load thereon and preventing the pressing lever 232 from stopping moving and thus becoming a locked state.

Figure 15A:
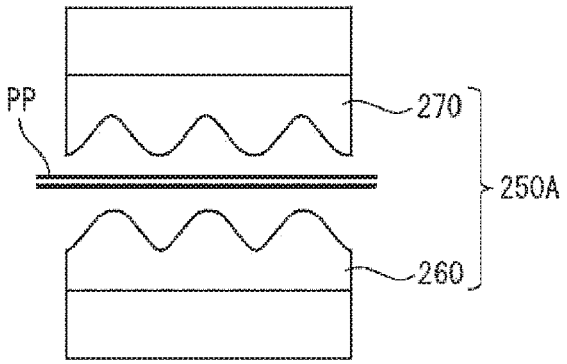
FIGS. 15A to 15D are views showing an exemplary process of crimping and binding a paper bundle by means of the binding teeth.
Figure 15C:
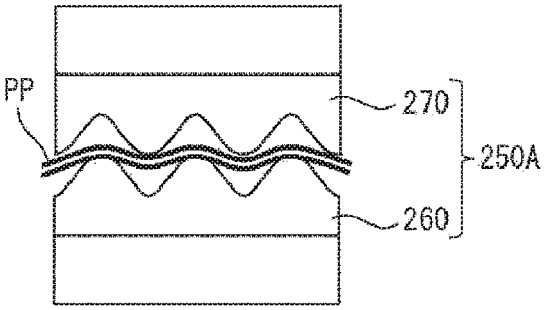
Figure 15B:
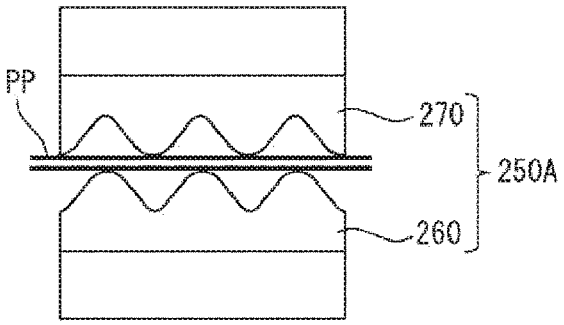
Figure 15D:
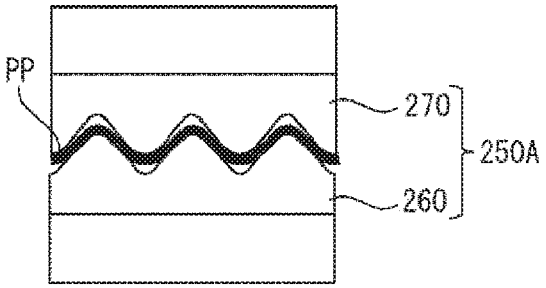

FIGS. 15A to 15D show an example of a process of crimping and binding a paper bundle PP by engaging the binding teeth 250A. As shown in FIG. 15A, a paper bundle PP having an aligned front end or side surface is conveyed to a binding position between the lower tooth 260 and the upper tooth 270. Subsequently, as shown in FIGS. 15B and 15C, the upper tooth 270 moves downward so that the upper tooth 270 engages with the lower tooth 260. Subsequently, as shown in FIG. 15D, if the maximum load is exerted on the upper tooth 270, the paper bundle PP is deformed into an uneven shape and thus crimped together. By this process, a crimped booklet is produced.

[Exemplary Configuration of Binding Teeth 250A]

Figure 16A:
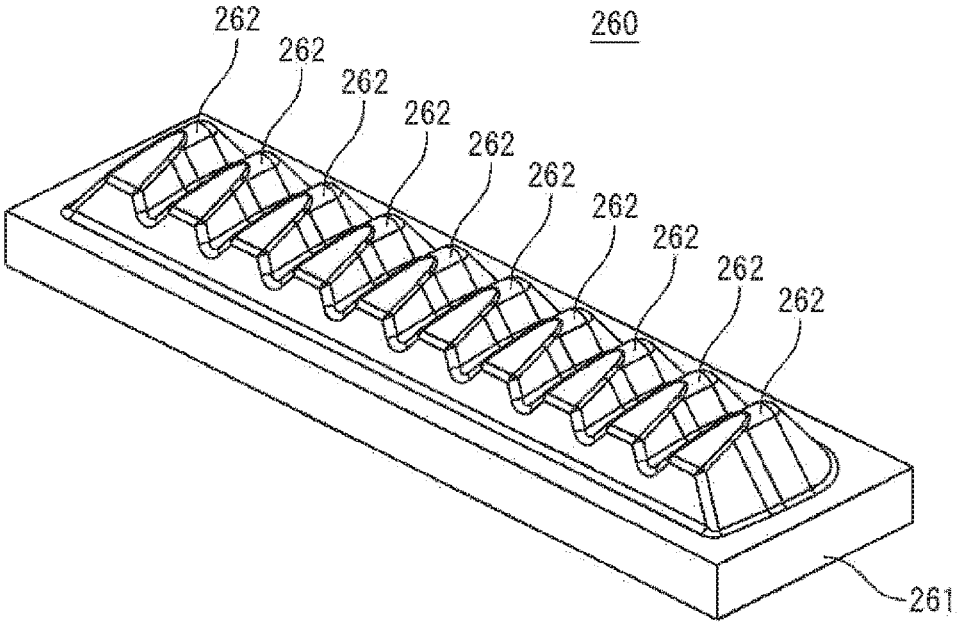
FIG. 16A is a perspective view of a lower tooth of the binding teeth and FIG. 16B is a main part thereof.
Figure 16B:
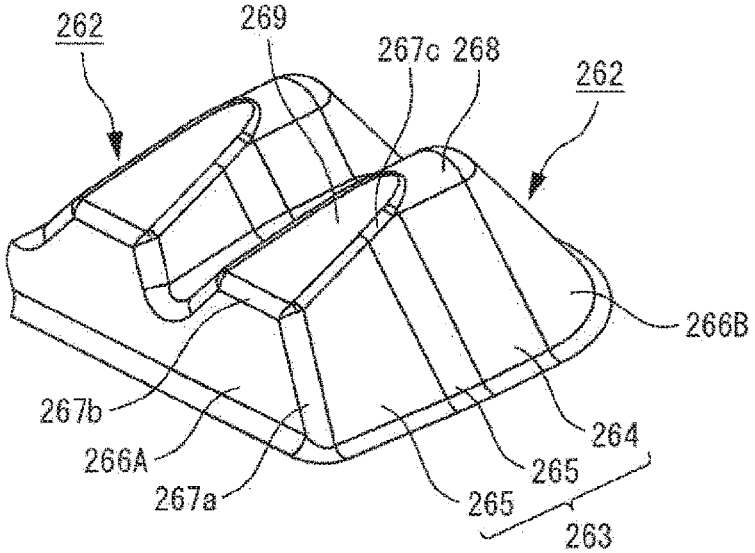
Figure 17A:
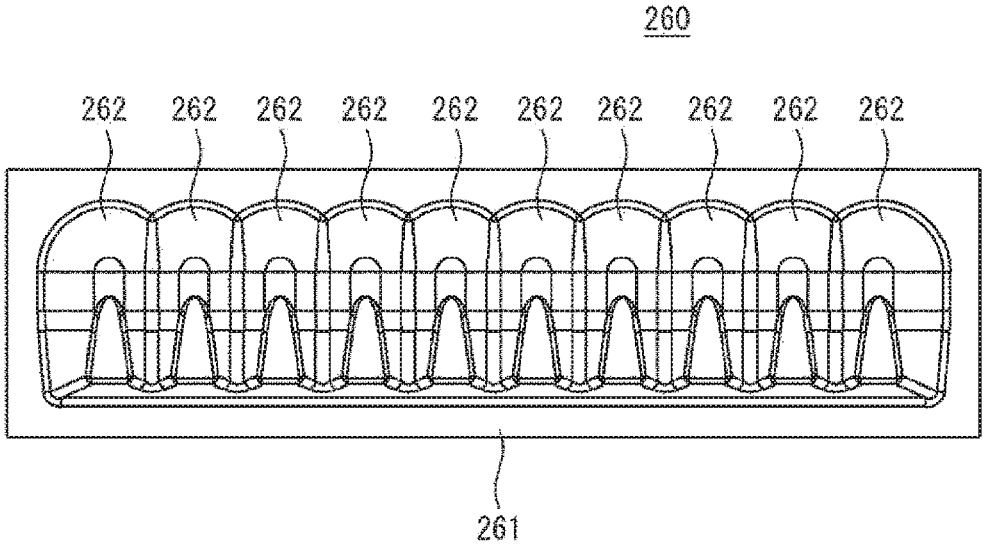
FIG. 17A is a plan view of the lower tooth of the binding teeth.
Figure 17B:
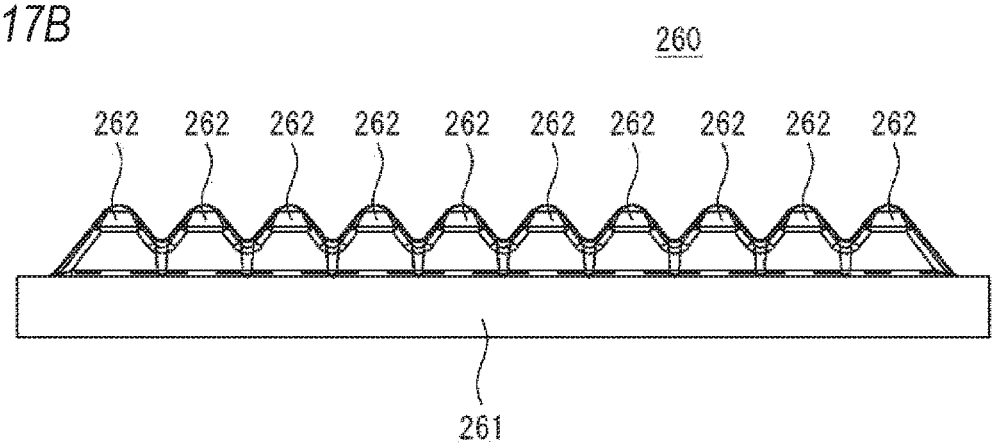
FIG. 17B is a front view thereof and FIG. 17C is a side view thereof.
Figure 17C:
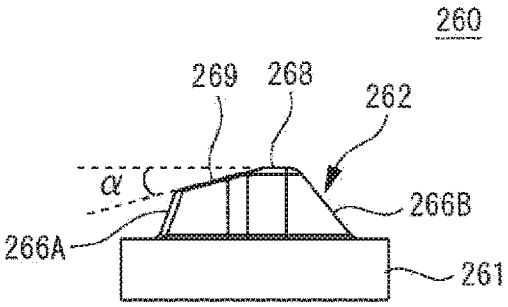
Figure 18A:
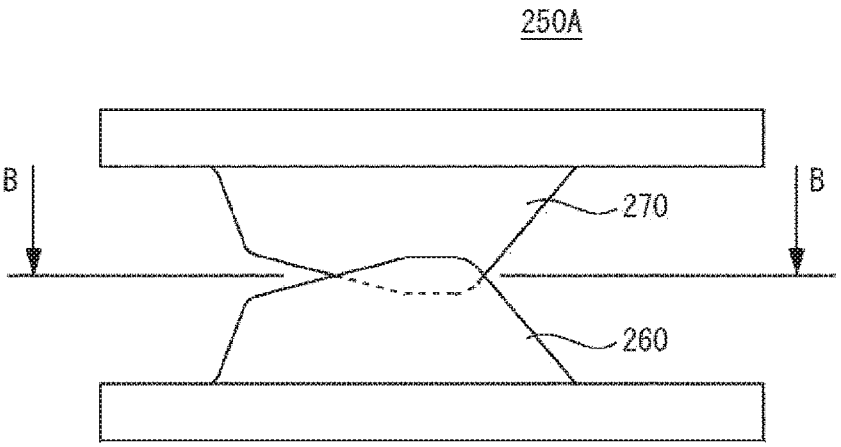
FIG. 18A is a side view of the binding teeth when the lower tooth and the upper tooth are engaged with each other.
Figure 18B:
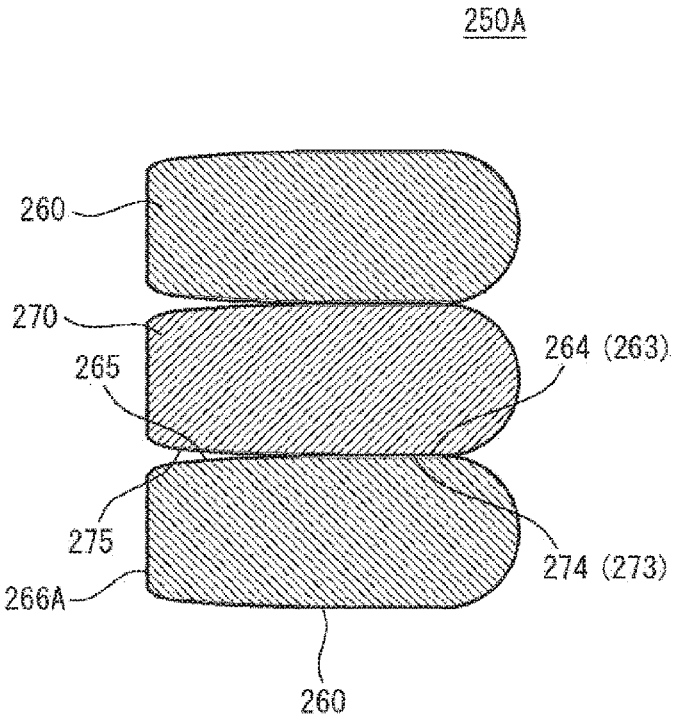
FIG. 18B is a sectional plan view taken along a line B-B therein.

FIG. 16A is a perspective view showing an example of a configuration of the lower tooth 260 constituting the binding teeth 250 according to the present invention, and FIG. 16B shows a main part thereof. FIG. 17A is a plan view of the lower tooth 260, FIG. 17B is a front view thereof and FIG. 17C is a side view thereof. FIG. 18A is a side view of the binding teeth 250A when the lower tooth 260 and the upper tooth 270 are engaged with each other, and FIG. 18B is a sectional plan view taken along a line B-B therein. Meanwhile, since the lower tooth 260 and the upper tooth 270 have the same configuration, only the configuration of the lower tooth 260 will be described below as a representative.

As shown in FIGS. 16 to 18, the lower tooth 260 includes an elongated rectangular parallelepiped base 261 and a plurality of tooth portions 262 as an example of a plurality of convex portions formed on the base 261. Each of the tooth portions 262 is an elongated convex body and is made of a metal material, such as SK material (carbon tool steel) or SUS material. The tooth portion 262 has a side surface portion 263 as an example of an opposing surface opposing a convex portion of the other tooth portion; a front surface portion 266A, which is an end surface portion as an example of an end surface configured as a surface along a convex direction; a top surface portion 268; and an inclined surface portion 269. A first ridge portion 267*a* is provided on a boundary between the front surface portion 266A and the side surface portion 263. A second ridge portion 267*b* is provided on a boundary between the front surface portion 266A and the inclined surface portion 269. A third ridge portion 267*c* is provided on a boundary between the inclined surface portion 269 and the side surface portion 263. For example, each of the first ridge portion 267*a*, the second ridge portion 267*b* and the third ridge portion 267*c* is a rounded surface.

The side surface portion 263 is a surface opposing a side surface portion of the upper tooth 270 when engaging with the upper tooth 270, which makes the pair with the lower tooth 260, and has a function of coupling sheets of paper P together by sandwiching and crimping the sheets of paper P between itself and the upper tooth 270. The side surface portion 263 has an abutting surface portion 264 and a non-abutting surface portion 265.

The abutting surface portion 264 is a surface contiguous to the top surface portion 268 and also a surface abutting (contacting) against an opposing abutting surface portion 274 of the upper tooth 270 when engaging with the upper tooth 270 without sheets of paper P.

The non-abutting surface portion 265 is a surface contiguous to the abutting surface portion 264 and is provided between the abutting surface portion 264 and the first ridge portion 267*a*. The non-abutting surface portion 265 is a surface defining a gap between itself and an opposing side surface portion of the upper tooth 270 when engaging with the upper tooth 270 without sheets of paper P (which does not abut against the side surface portion of the upper tooth 270). In addition, the non-abutting surface portion 265 has a function of crimping the paper bundle although weaker than is the abutting surface portion 264. Further, as shown in FIGS. 18A and 18B, a distance between the non-abutting surface portion 265 of the lower tooth 260 and a non-abutting surface portion 275 (side surface portion 273) of the upper tooth 270 when the lower tooth 260 and the upper tooth 270 are engaged with each other is gradually increased toward the front surface portion 266A as an example of an end surface portion (forward). By providing the non-abutting surface portion 265, a local elongation of sheets of paper at the first ridge portion 267*a*, the second ridge portion 267*b* and the third ridge portion 267*c* can be reduced. Meanwhile, although in the present embodiment, the non-abutting surface portion 265 is constituted of two surfaces having different angles, the non-abutting surface portion 265 may be constituted of a single surface or three or more surfaces.

The top surface portion 268 is a surface provided on a peak of the tooth portion 262 and is constructed by a curved surface. Alternatively, the top surface portion 268 may be constructed by a flat surface.

The inclined surface portion 269 is a surface inclined from the top surface portion 268 toward the front surface portion 266A. In the present embodiment, as shown in FIG. 17C, an angle $\alpha$ defined between the top surface portion 268 and the inclined surface portion 269 is set to have a range of $0° < \alpha \leq 20°$. By having such a range, as described below, it is possible to prevent sheets of paper from being locally elongated when binding a paper bundle, thereby preventing a booklet from tearing.

The front surface portion 266A is configured to be bent from one end side of the side surface portion 263 and to be inclined at an angle greater than, for example, 45° with respect to a horizontal surface of the base 261. Also, the front surface portion 266A is configured to face the center side (inner side) of a paper bundle to be crimped and bound, when being positioned at a position, at which sheets of paper P are sandwiched and bound. Meanwhile, a rear surface portion 266B of the binding teeth 250 faces an outer side of the paper bundle and is constructed by, for example, a curved surface.

The plurality of tooth portions 262 are arranged side by side along a direction perpendicular to a longitudinal direction of the tooth portions 262 so that longitudinal directions of the plurality of tooth portions 262 are parallel to each other, thereby forming a row in a predetermined direction.

Meanwhile, although in FIG. 17A and the like, the plurality of tooth portions 262 has the same length in the longitudinal direction thereof, the present invention is not limited thereto. For example, a length, in the longitudinal direction, of tooth portions 262 of the plurality of tooth portions 262, which are arranged on both end sides thereof, may be configured to be longer than a length, in the longitudinal direction, of tooth portions 262 arranged on the middle portion therebetween. Also, a length, in the longitudinal direction, of the side surface portion 263 and the like of each of the plurality of tooth portions 262 may be configured to be different from each other, and also a plurality of tooth portions 262 having different lengths in the longitudinal direction may be alternately arranged. Lengths of the tooth portions 262 in the longitudinal direction may be constituted of two lengths including a first length and a second length longer than the first length or may be constituted of three or more different lengths.

Further, in the case of the upper tooth 270, only reference numerals thereof are different from those of the lower tooth 260 shown in FIGS. 16A, 16B and the like, and accordingly the other configurations are common. Although not shown, the upper tooth 270 includes tooth portions 272, each of which has a side surface portion 273 including an abutting surface portion 274 and a non-abutting surface portion 275; a front surface portion 276A as an example of an end surface portion; a top surface portion 278; an inclined surface portion 279; a first ridge portion 277*a*; a second ridge portion 277*b*; and a third ridge portion 277*c* (see FIGS. 16A and 16B).

[Binding Position for Bound Portion]

FIG. 19A to 19*j* are views explaining binding positions for bound portions Pa to Pj formed by crimping and binding a paper bundle by means of the binding teeth 250A.

Figure 19A:
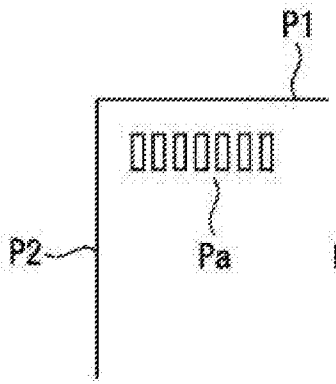
FIG. 19A to 19J are views explaining binding positions for bound portions Pa to Pj formed by crimping and binding a paper bundle by means of the binding teeth.
Figure 19B:
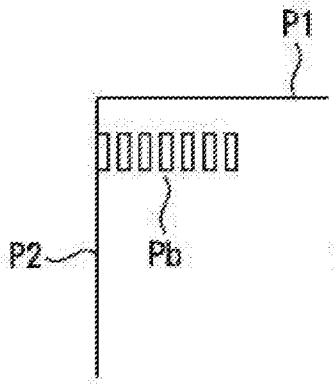

As shown in FIG. 19A, the bound portion Pa is formed in the vicinity of a corner of the paper bundle in such a manner that an array direction of unevenness formed by crimping of the binding processing (hereinafter, referred to as unevenness of the bound portion) extends along a side P1. As shown in FIG. 19B, the bound portion Pb is formed in the vicinity of the corner of the paper bundle in such a manner that an array direction of unevenness of the bound portion Pb extends along the side P1 and also the entire bound portion Pb is positioned close to a side P2. Also, the bound portion Pb may depend on the side P2.

Figure 19C:
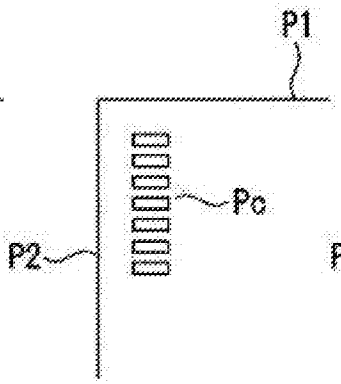
Figure 19D:
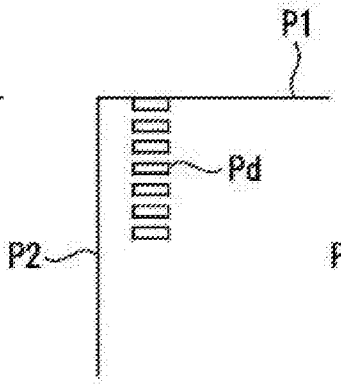

As shown in FIG. 19C, the bound portion Pc is formed in the vicinity of a corner of the paper bundle in such a manner that an array direction of unevenness of the bound portion Pc extends along the side P2. As shown in FIG. 19D, the bound portion Pd is formed in the vicinity of the corner of the paper bundle in such a manner that an array direction of unevenness of the bound portion Pd extends along the side P2 and also the entire bound portion Pd is positioned close to the side P1. Also, the bound portion Pd may depend on the side P1.

Figure 19E:
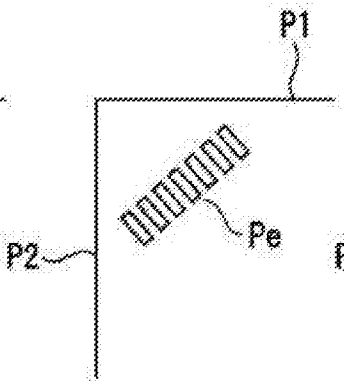
Figure 19F:
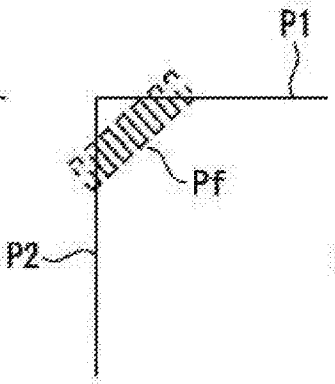

As shown in FIG. 19E, the bound portion Pe is formed in the vicinity of the corner of the paper bundle in such a manner that an array direction of unevenness of the bound portion Pe extends at an angle of approximately 45° with respect to the sides P1, P2. As shown in FIG. 19F, the bound portion Pf is formed in the vicinity of the corner of the paper bundle in such a manner that an array direction of unevenness of the bound portion Pf extends at an angle of approximately 45° with respect to the sides P1, P2 and also both end portions thereof extend beyond the sides P1, P2, respectively (i.e., across the corner).

Figure 19G:
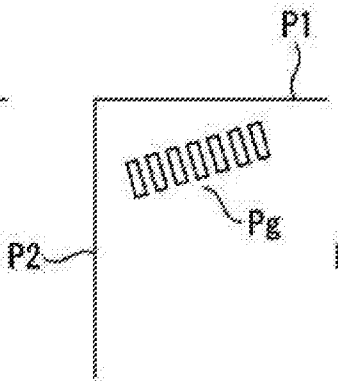
Figure 19H:
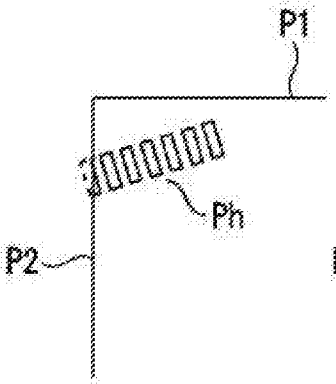

As shown in FIG. 19G, the bound portion Pg is formed in the vicinity of the corner of the paper bundle in such a manner that an array direction of unevenness of the bound portion Pg is inclined at an angle with respect to the side P1 slightly gentler than that of the array direction of unevenness of the bound portion Pe shown in FIG. 19E. As shown in FIG. 19H, the bound portion Ph is formed in the vicinity of the corner of the paper bundle in the same direction as the array direction of unevenness of the bound portion Pg, but in such a manner that one end portion thereof extends beyond the side P2.

Figure 19I:
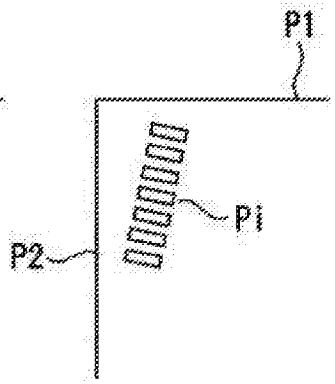
Figure 19J:
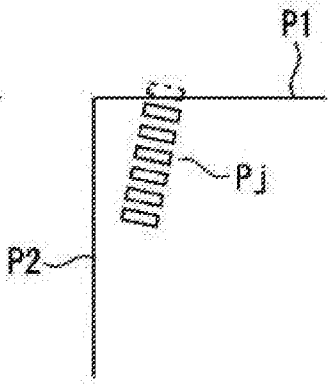

As shown in FIG. 19I, the bound portion Pi is formed in the vicinity of the corner of the paper bundle in such a manner that an array direction of unevenness of the bound portion Pi is inclined at an angle with respect to the side P2 slightly gentler than that of the array direction of unevenness of the bound portion Pe shown in FIG. 19E. As shown in FIG. 19J, the bound portion Pj is formed in the vicinity of the corner of the paper bundle in the same direction as the array direction of unevenness of the bound portion Pi, but in such a manner that one end portion thereof extends beyond the side P1.

In any cases shown in FIGS. 19A to 19J, the front surface portion 266A of the binding teeth 250A as an example of an end surface portion is arranged to face the center side (inner side) of the paper bundle. By arranging the front surface portion 266A in this way, it is possible to increase a peeling-off load required to turn over and peel off a sheet of paper from the crimped paper bundle, thereby making it difficult to peel off the sheet of paper.

Meanwhile, although the cases where binding is performed at such binding positions that the array directions of the bound portions Pa to Pj are within a range of 00 to 90° in the corner of the paper bundle have been described in the present embodiment, it is more preferable that a bound portion is formed within a range of 0° to 30° with respect to a paper grain direction of sheets of paper P.

[Variant of Binding Teeth]

Figure 20A:
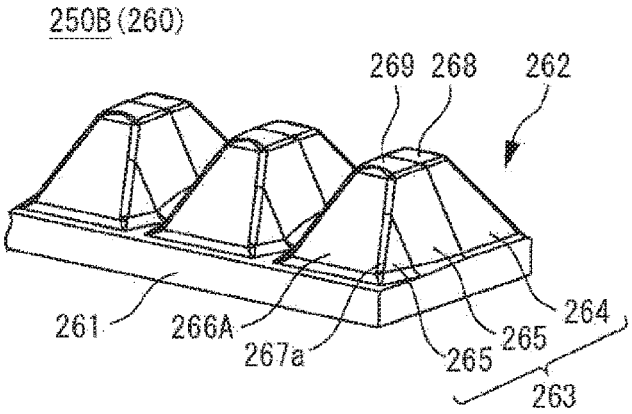
FIG. 20A is a perspective view showing an example of a configuration of the lower tooth of the binding teeth.
Figure 20B:
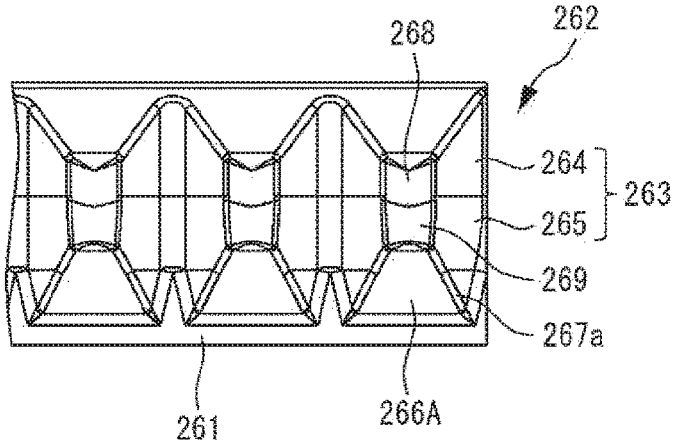
FIG. 20B is a plan view thereof.
Figure 20C:
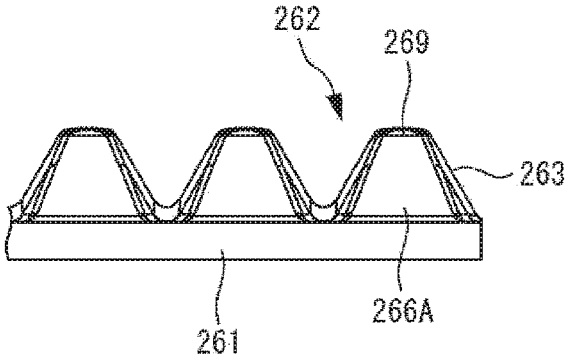
FIG. 20C is a front view thereof and FIG. 20D is a side view thereof.
Figure 20D:
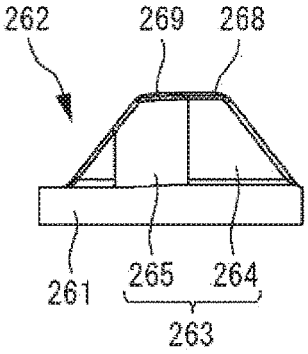

FIG. 20A is a perspective view showing an example of a configuration of a lower tooth 260 of binding teeth 250B according to the present invention, FIG. 20B is a plan view thereof, FIG. 20C is a front view thereof and FIG. 20D is a side view thereof. Meanwhile, elements, which have substantially the same functional configuration as those of the binding teeth 250A, are designated by the same reference numerals, and the overlapping description thereof will be omitted. Further, since the lower tooth 260 and the upper tooth 270 have the same configuration, only the configuration of the lower tooth 260 will be described below as a representative.

The lower tooth 260 of the binding teeth 250B includes a base 261 and a plurality of tooth portions 262 formed on the base 261. Each of the tooth portions 262 has a side surface portion 263 including an abutting surface portion 264 and a non-abutting surface portion 265; a front surface portion 266A as an example of an end surface portion; a first ridge portion 267*a* a top surface portion 268; and an inclined surface portion 269. The binding teeth 250B is configured such that the inclined surface portion 269 has an inclination angle smaller than that of the binding teeth 250A and a surface thereof is formed as a curved surface.

Figure 21A:
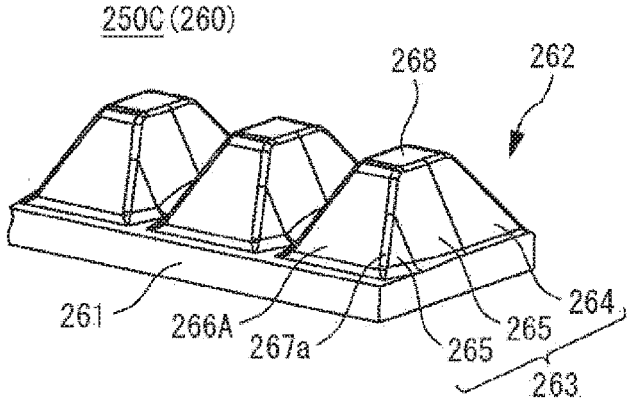
FIG. 21A is a perspective view showing an example of a configuration of the lower tooth of the binding teeth.
Figure 21B:
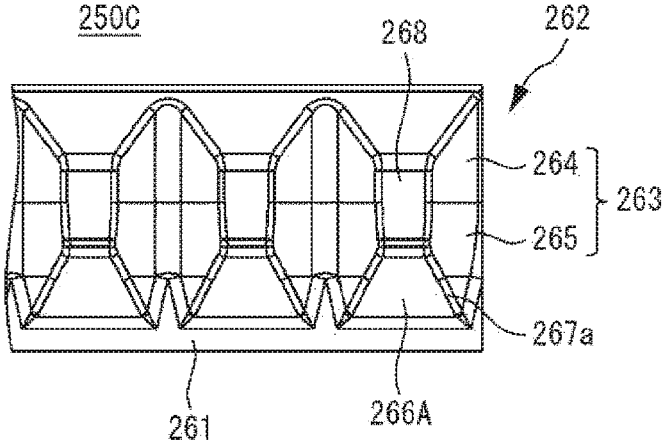
FIG. 21B is a plan view thereof.
Figure 21C:
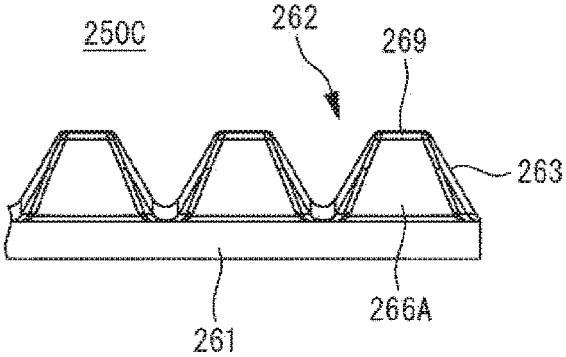
FIG. 21C is a front view thereof and FIG. 21D is a side view thereof.
Figure 21D:
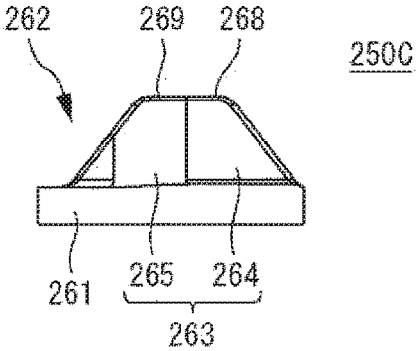

FIG. 21A is a perspective view showing an example of a configuration of a lower tooth 260 of binding teeth 250C according to the present invention, FIG. 21B is a plan view thereof, FIG. 21C is a front view thereof and FIG. 21D is a side view thereof. Meanwhile, elements, which have substantially the same functional configuration as those of the binding teeth 250A, are designated by the same reference numerals, and the overlapping description thereof will be omitted. Further, since the lower tooth 260 and the upper tooth 270 have the same configuration, only the configuration of the lower tooth 260 will be described below as a representative.

The lower tooth 260 of the binding teeth 250C includes a base 261 and a plurality of tooth portions 262 formed on the base 261. Each of the tooth portions 262 has a side surface portion 263 including an abutting surface portion 264 and a non-abutting surface portion 265; a front surface portion 266A as an example of an end surface portion; a first ridge portion 267*a*; and a top surface portion 268. The binding teeth 250C is different from the configuration of the binding teeth 250A in that an inclined surface portion is not provided thereon.

Figure 22A:
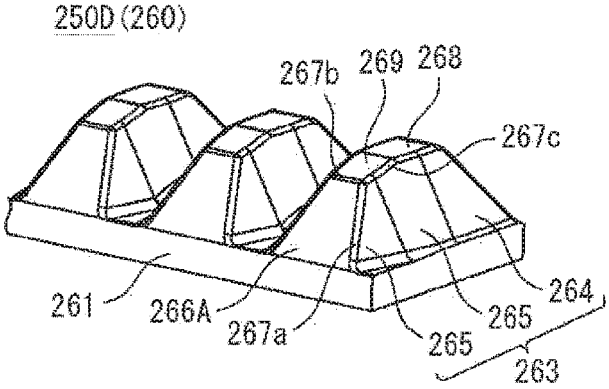
FIG. 22A is a perspective view showing an example of a configuration of the lower tooth of the binding teeth.
Figure 22B:
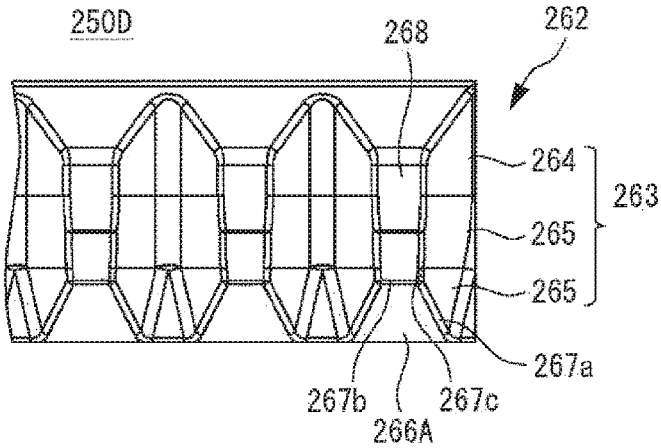
FIG. 22B is a plan view thereof.
Figure 22C:
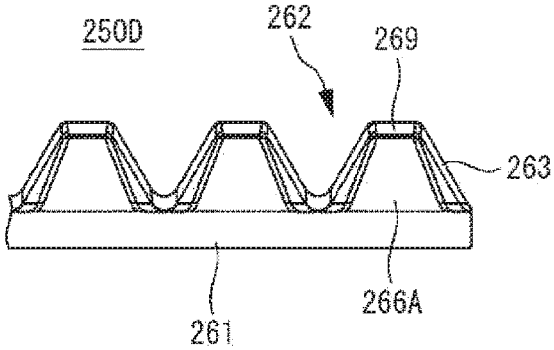
FIG. 22C is a front view thereof and FIG. 22D is a side view thereof.
Figure 22D:
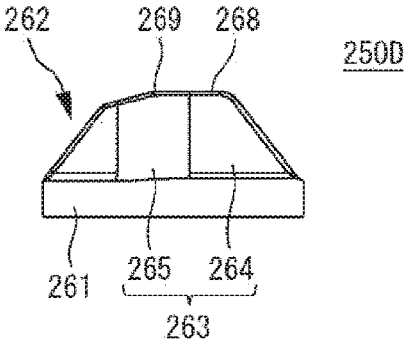

FIG. 22A is a perspective view showing an example of a configuration of a lower tooth 260 of binding teeth 250D according to the present invention, FIG. 22B is a plan view thereof, FIG. 22C is a front view thereof and FIG. 22D is a side view thereof. Meanwhile, elements, which have substantially the same functional configuration as those of the binding teeth 250A, are designated by the same reference numerals, and the overlapping description thereof will be omitted. Further, since the lower tooth 260 and the upper tooth 270 have the same configuration, only the configuration of the lower tooth 260 will be described below as a representative.

The lower tooth 260 of the binding teeth 250D includes a base 261 and a plurality of tooth portions 262 formed on the base 261. Each of the tooth portions 262 has a side surface portion 263 including an abutting surface portion 264 and a non-abutting surface portion 265; a front surface portion 266A as an example of an end surface portion; a first ridge portion 267*a*; a second ridge portion 267*b*; a top surface portion 268; and an inclined surface portion 269. The binding teeth 250D is configured such that the inclined surface portion 269 has an area smaller than that of the binding teeth 250A and also the front surface portion 266A has an inclination angle smaller than that of the binding teeth 250A.

Figure 23A:
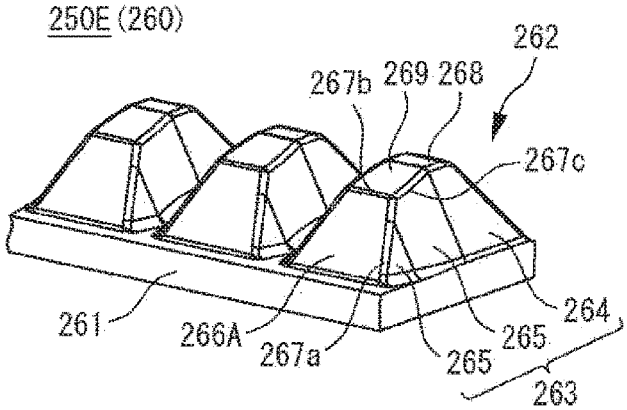
FIG. 23A is a perspective view showing an example of a configuration of the lower tooth of the binding teeth.
Figure 23B:
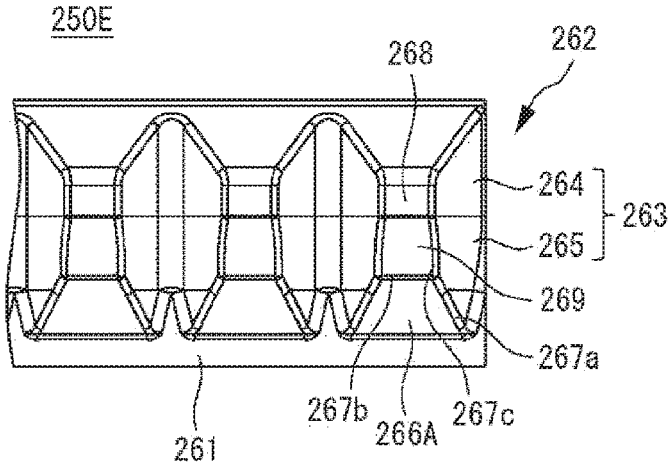
FIG. 23B is a plan view thereof.
Figure 23C:
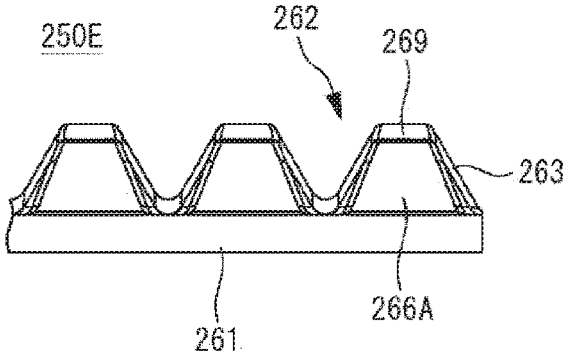
FIG. 23C is a front view thereof and FIG. 23D is a side view thereof.
Figure 23D:
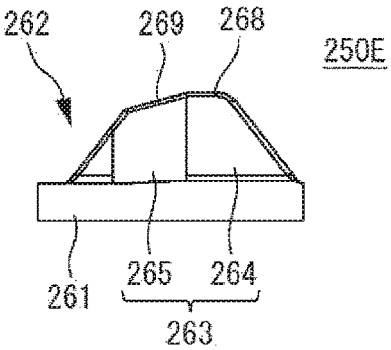

FIG. 23A is a perspective view showing an example of a configuration of a lower tooth 260 of binding teeth 250E according to the present invention, FIG. 23B is a plan view thereof, FIG. 23C is a front view thereof and FIG. 23D is a side view thereof. Meanwhile, elements, which have substantially the same functional configuration as those of the binding teeth 250A, are designated by the same reference numerals, and the overlapping description thereof will be omitted. Further, since the lower tooth 260 and the upper tooth 270 have the same configuration, only the configuration of the lower tooth 260 will be described below as a representative.

The lower tooth 260 of the binding teeth 250E includes a base 261 and a plurality of tooth portions 262 formed on the base 261. Each of the tooth portions 262 has a side surface portion 263 including an abutting surface portion 264 and a non-abutting surface portion 265; a front surface portion 266A as an example of an end surface portion; a first ridge portion 267*a*; a second ridge portion 267*b*; a top surface portion 268; and an inclined surface portion 269. The binding teeth 250E is configured such that the inclined surface portion 269 has an area smaller than that of the binding teeth 250A and also the front surface portion 266A has an inclination angle smaller than that of the binding teeth 250A.

Figure 24A:
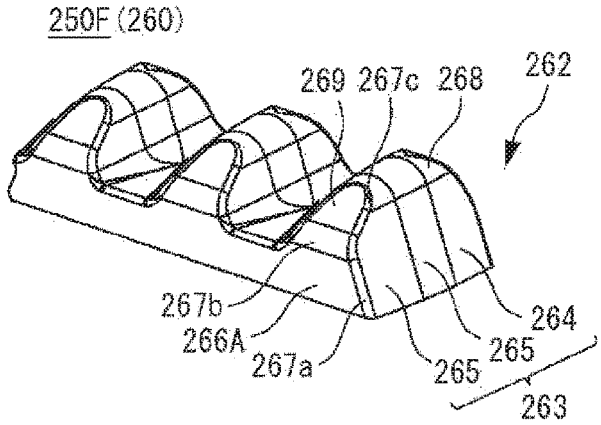
FIG. 24A is a perspective view showing an example of a configuration of the lower tooth of the binding teeth.
Figure 24B:
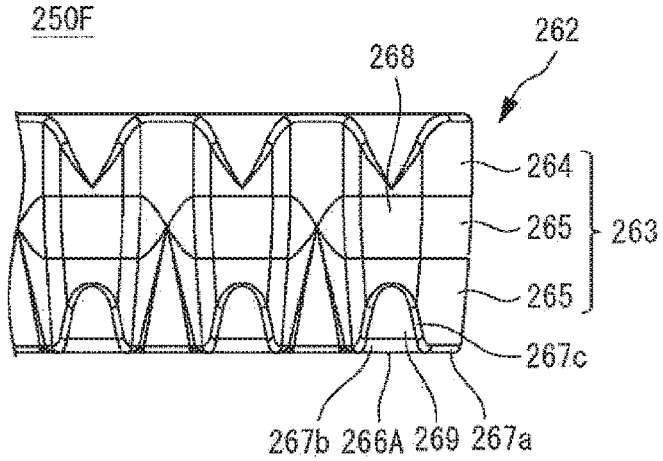
FIG. 24B is a plan view thereof.
Figure 24C:
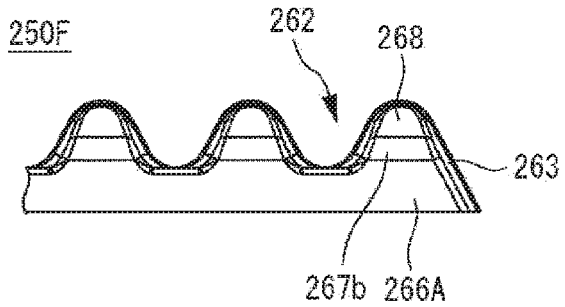
FIG. 24C is a front view thereof and FIG. 24D is a side view thereof.
Figure 24D:
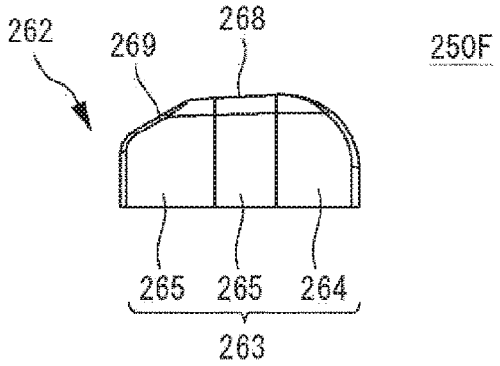

FIG. 24A is a perspective view showing an example of a configuration of a lower tooth 260 of binding teeth 250F according to the present invention, FIG. 24B is a plan view thereof, FIG. 24C is a front view thereof and FIG. 24D is a side view thereof. Meanwhile, elements, which have substantially the same functional configuration as those of the binding teeth 250A, are designated by the same reference numerals, and the overlapping description thereof will be omitted. Further, since the lower tooth 260 and the upper tooth 270 have the same configuration, only the configuration of the lower tooth 260 will be described below as a representative.

The lower tooth 260 of the binding teeth 250F includes a plurality of tooth portions 262. Each of the tooth portions 262 has a side surface portion 263 including an abutting surface portion 264 and a non-abutting surface portion 265; a front surface portion 266A as an example of an end surface portion; a first ridge portion 267*a*; a second ridge portion 267*b*; a top surface portion 268; and an inclined surface portion 269. The binding teeth 250F is different from the configuration of the binding teeth 250A in that a base is not provided thereon.

[Relationship Between Side Surface Separation Distance M and Compressive Contact Distance N]

Next, a side surface separation distance M and a compressive contact distance N preferable when crimp-binding a paper bundle will be described. In the binding teeth 250A associated with the present embodiment, the compressive contact distance N when crimping a paper bundle is 0 mm or greater when the side surface separation distance M is 0.23 mm or greater and 0.35 mm or smaller.

FIG. 25 is a view explaining the side surface separation distance M and the compressive contact distance N. As shown in FIG. 25, the side surface separation distance M is a length between the abutting surface portion 264 of the lower tooth 260 and the abutting surface portion 274 of the upper tooth 270, as measured along a normal line thereto, when a paper bundle has been crimped by engaging the lower tooth 260 and the upper tooth 270 with each other. The compressive contact distance N is a length, over which the abutting surface portion 264 of the lower tooth 260 and the abutting surface portion 274 of the upper tooth 270 oppose parallel to each other when engaging the lower tooth 260 and the upper tooth 270 to crimp a paper bundle therebetween.

FIG. 26 is a view showing a verification result of a retention force at a bound portion of a paper bundle in cases of using a plurality of types of binding teeth and also varying a distance O between a lower tooth and an upper tooth of each of types of binding teeth and varying the side surface separation distance M to cause the compressive contact distance N to become 0 mm. Meanwhile, as shown in FIG. 25, the distance O is a distance between a peak portion and a valley portion of the lower tooth (upper tooth). Also, in Examples 1 to 3 and Comparative Examples 1 to 3, the binding teeth 250A according to the present invention, which are different in size but similar in shape, were used.

Further, evaluation indexes on a holing force of bound portions shown in FIG. 26 are as follows.

◎: The bound portion is firmly stuck to sufficiently withstand for practical use of a bound booklet.

○: The bound portion is not easily peeled off when a sheet of paper is turned over.

x: The bound portion is easily peeled off when a sheet of paper is turned over.

As shown in FIG. 26, according to Examples 1 to 3, the distances O between the peak portion and the valley portion of the lower tooth were 0.63 mm to 0.96 mm, and also when the side surface separation distances M were 0.23 mm or greater and 0.35 mm or smaller, the compressive contact distances N were set to 0 mm. As a result, all binding retention forces for two, five and ten sheets were "○" or "◎".

In contrast, according to Comparative Examples 1 and 2, the distances O between the peak portion and the valley portion of the lower tooth were 0.27 mm and 0.55 mm, and also when the side surface separation distances M were smaller than 0.23 mm, the compressive contact distances N were set to 0 mm. As a result, all binding retention forces for two and five sheets were "○", but all binding retention forces for ten sheets were "x". This is because in the case of a paper bundle of ten sheets, the compressive contact distance N disappears and a bonding force between sheets of paper weakens, so that a binding retention force is decreased.

Also, according to Comparative Example 3, the distance O between the peak portion and the valley portion of the lower tooth was 1.09 mm, and also when the side surface separation distances M was greater than 0.35 mm, the compressive contact distances N was set to 0 mm. Similarly, all binding retention forces for five and ten sheets were "○", but all binding retention forces for two sheets were "x". This is because in the case of a paper bundle of two sheets, a load obtained by crimping is insufficient and thus the paper bundle cannot be sufficiently bound.

Thus, by using the binding teeth 250A according to the present embodiment, in which, in the case where the side surface separation distance M when a paper bundle has been crimped is 0.23 mm or greater and 0.35 mm or smaller, it is possible to set the compressive contact distance N to 0 mm, it is possible to suitably crimp and bind a paper bundle of two to ten sheets, which is commonly used in crimp-binding, without tearing.

Meanwhile, although in the present example, the binding teeth 250A according to the present embodiment was used as binding teeth, the present invention is not limited thereto. It was found that results similar to the results shown in FIG. 26 can be obtained even if the binding teeth 250B to 250F as described above are used. Also, it was found that even in the case of binding teeth (not shown), on which a non-abutting surface portion or inclined surface portion is not provided, results similar to the results shown in FIG. 26 can be obtained by setting the compressive contact distance N to 0 mm or greater when the side surface separation distance M is 0.23 mm or greater and 0.35 mm or smaller. Further, it was found that results similar to the results shown in FIG. 26 can be obtained even if the compressive contact distance N is greater than 0 mm when the side surface separation distance M is 0.23 mm or greater and 0.35 mm or smaller.

[Elongation Rate and Rate of Change in Elongation Rate]

Next, a rate of change in elongation rate preferable when crimp-binding a paper bundle will be described. In the present embodiment, the binding teeth 250A having the non-abutting surface portion 265, 275 and the inclined surface portion 269, 279 are used. Accordingly, it is possible to reduce the rate of change in elongation rate as compared with the conventional cases, thereby preventing tearing in a booklet after binding.

Figure 27:
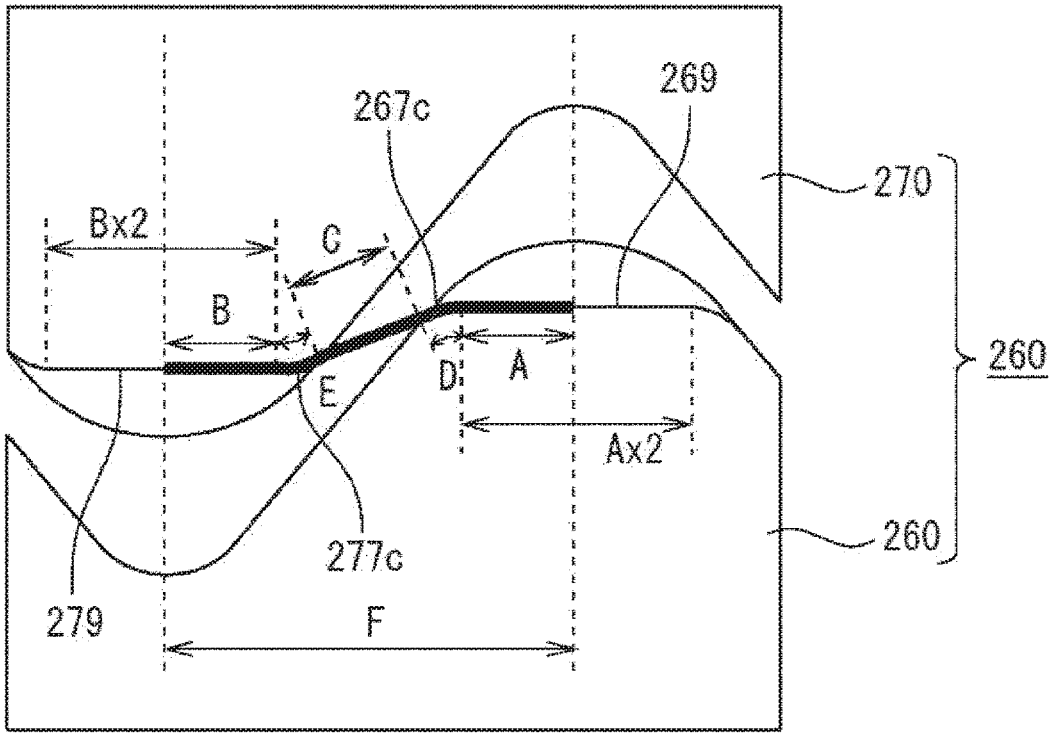
FIG. 27 is a view explaining an elongation rate.

First, the elongation rate will be described. FIG. 27 is a view explaining the elongation rate and shows a part of a cross section of teeth 250 taken in a direction perpendicular to a longitudinal direction thereof. Meanwhile, in FIG. 27, the side surface separation distance M between the lower tooth 260 and the upper tooth 270 (see FIG. 25) is 0.09 mm. The side surface separation distance M=0.09 mm corresponds to a thickness of a paper bundle of two sheets of common copy paper after crimping thereof.

In the present embodiment, the elongation rate virtually indicates an elongation of a paper bundle when engaged and crimped by the teeth 250 with respect to a reference length of the paper bundle when not crimped. The elongation rate is defined by the following equation (1) based on lengths A to E of parts of the binding teeth 250A shown in FIG. 27.

$$\text{Elongation Rate}=(A+B+C+D+E)/F \quad (1)$$

where A: a half of a length of a linear part of the inclined surface portion 269 of the lower tooth 260;

B: a half of a length of a linear part of the inclined surface portion 279 of the upper tooth 270:

C: a length of a common tangent part of the third ridge portion 267*c* of the lower tooth 260 and the third ridge portion 277*c* of the upper tooth 270;

D: a length along a curved line from an intersection point between the third ridge portion 267*c* and the linear part of the inclined surface portion 269 of the lower tooth 260 to the common tangent part;

E: a length along a curved line from an intersection point between the third ridge portion 277*c* and the linear part of the inclined surface portion 279 of the upper tooth 270 to the common tangent part; and F: a length between the center point of the linear part of the inclined surface portion 269 of the lower tooth 260 and the center point of the linear part of the inclined surface portion 279 of the upper tooth 270.

Figure 28:
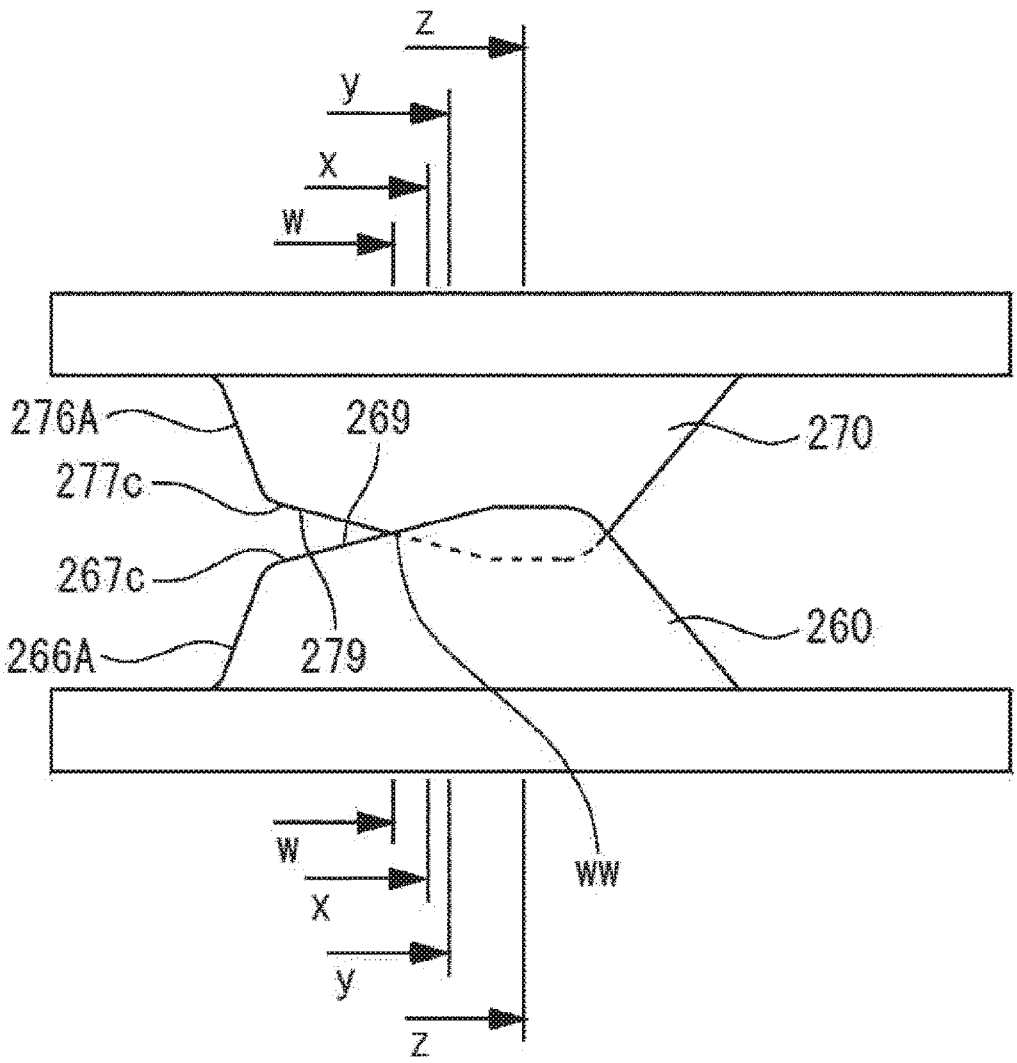
FIG. 28 is a view showing an exemplary configuration of a lower tooth and an upper tooth in an engaged state as viewed from the side thereof.
Figure 29A:
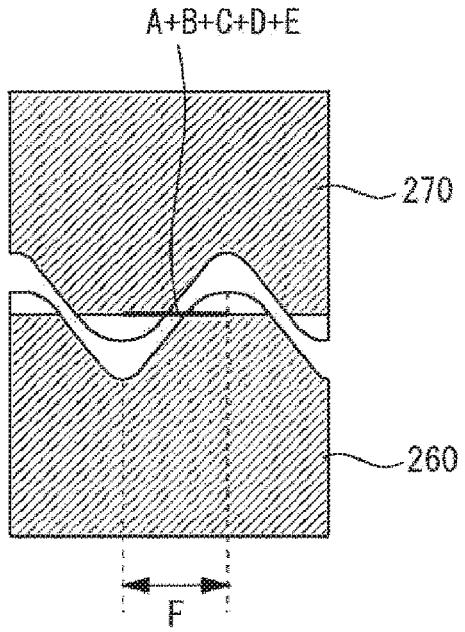
Figure 29C:
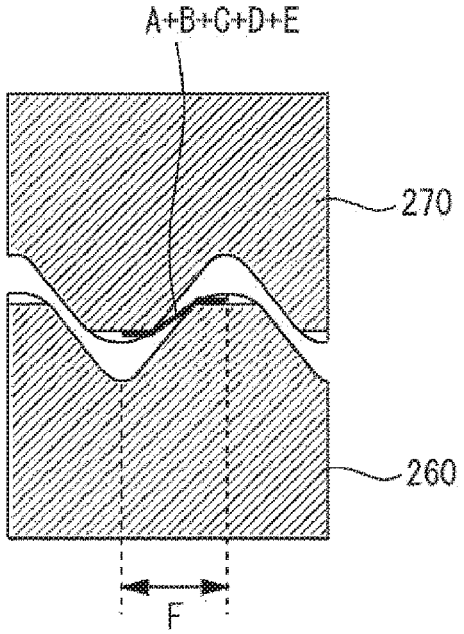
Figure 29B:
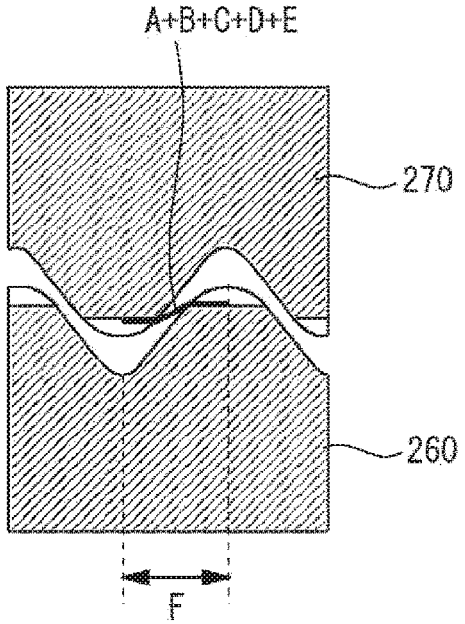
Figure 29D:
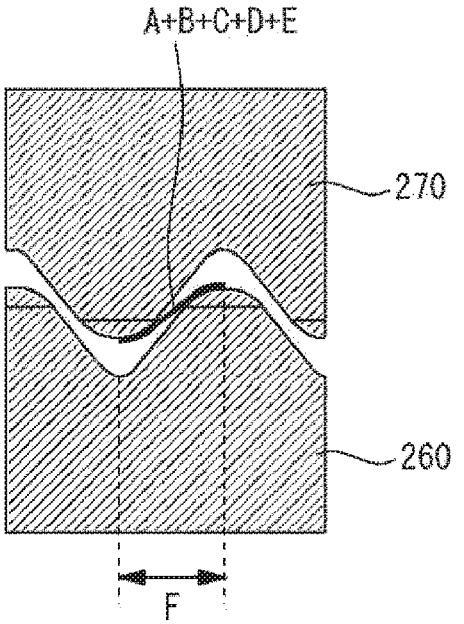

FIG. 28 shows a side view of the lower tooth 260 and the upper tooth 270 in an engaged state. FIGS. 29A to 29D are views showing an elongation rate at each of cross-sections of the binding teeth 250A shown in FIG. 28. FIG. 29A is a sectional view of the binding teeth 250A taken along a line w-w, FIG. 29B is a sectional view of the binding teeth 250A taken along a line x-x, FIG. 29C is a sectional view of the binding teeth 250A taken along a line y-y, and FIG. 29D is a sectional view of the binding teeth 250A taken along a line z-z. Meanwhile, the cross section taken along the line w-w as shown in FIG. 29A is a cross section at a location ww where the lower tooth 260 and the upper tooth 270 starts to engage with each other.

As shown in FIGS. 29A to 29D, it is possible to make the elongation rate gradually reduce toward the second ridge portion 267*b* on the side of the front surface portion 266A, since the binding teeth 250A is provided with the non-abutting surface portion 265 and the inclined surface portion 269. In this way, by making the elongation rate gradually change from the top surface portion 268 toward the front surface portion 266A, it is possible to prevent a sharp change in the elongation rate when the start of engagement of the binding teeth 250A is taken as a reference. Meanwhile, although an example in which the front surface portion 266A has a flat surface part is shown in FIG. 28, it is not always necessary to have the flat surface part, and accordingly the front surface portion 266A may be constructed by a curved surface.

Next, the rate of change in elongation rate will be described. In the present embodiment, the rate of change in elongation rate means a rate of change in elongation rate between two cross sections of the binding teeth 250A taken in a direction perpendicular to the longitudinal direction thereof and is an index indicating easiness of tearing in a paper bundle upon crimping thereof. The rate of change in elongation rate is defined by the following equation (2).

$$\text{Rate of Change in Elongation Rate}=(\text{Elongation Rate } Y-\text{Elongation Rate } X)\text{Distance } Z \quad (2)$$

where Elongation Rate X: an elongation rate at a cross section X:

Elongation Rate Y: an elongation rate at a cross section Y; and

Distance Z: a distance between the cross section X and the cross section Y.

FIG. 30A is a graph showing a rate of change in elongation rate in cases of using a plurality of types of binding teeth. In FIG. 30A a vertical axis represents a rate of change in elongation rate and a horizontal axis represents a distance from the start of engagement of teeth. FIG. 30B shows shapes of the binding teeth used in FIG. 30A and also a verification result on tearing in a bound booklet when binding of a paper bundle has been performed using the binding teeth. Meanwhile, in FIG. 30B, the mark ○ indicates that no tearing occurs in a bound booklet, and the mark x indicates that tearing occurs in a bound booklet. Binding teeth A are the binding teeth 250A as described in the present embodiment and thus has the non-abutting surface portion 265, 275 and the inclined surface portion 269, 279. Binding teeth D are binding teeth according to the related art and thus have no non-abutting surface and inclined surface portion. Binding teeth B. C have a non-abutting surface portion and also have an inclined surface portion configured in a curved surface shape. The binding teeth B are different from the binding teeth C in that the binding teeth B have a front surface portion. Meanwhile, a paper bundle often sheets was used.

As shown in FIGS. 30A and 30B, in the case of using the binding teeth A, the rate of change in elongation gradually increased from the start of engagement up to a peak value, which is smaller than 0.4, and then gradually decreased, since the non-abutting surface portions 265, 275 and the inclined surface portions 269, 279 are provided thereon. Therefore, as shown in FIG. 30B, in the case of using the binding teeth A, the peak value of the rate of change in elongation rate did not exceed 0.4, thereby preventing a sharp change in elongation upon crimping of a paper bundle. As a result, tearing did not occur in a booklet after binding.

In the case of using the binding teeth B, the rate of change in elongation rate sharply increased from the start of engagement of the binding teeth B, but a peak value of the rate of change in elongation rate did not exceed 0.4. As a result, tearing did not occur in a booklet after binding.

In contrast, in the case of using the binding teeth C, the rate of change in elongation rate sharply increased from the start of engagement, exceeded 0.4 and then sharply decreased. In the case of using the binding teeth D, the rate of change in elongation rate increased with an inclination greater than that in the binding teeth A, exceeded 0.4 and then gradually decreased. In this case, as shown in FIG. 30B, upon crimping of a paper bundle, a sharp change in elongation occurred at a second ridge portion 267*b*, a third ridge portion 267*c* or the like. As a result, tearing occurred in a booklet after binding.

<Exemplary Block Configuration of Image Formation System 300>

Figure 31:
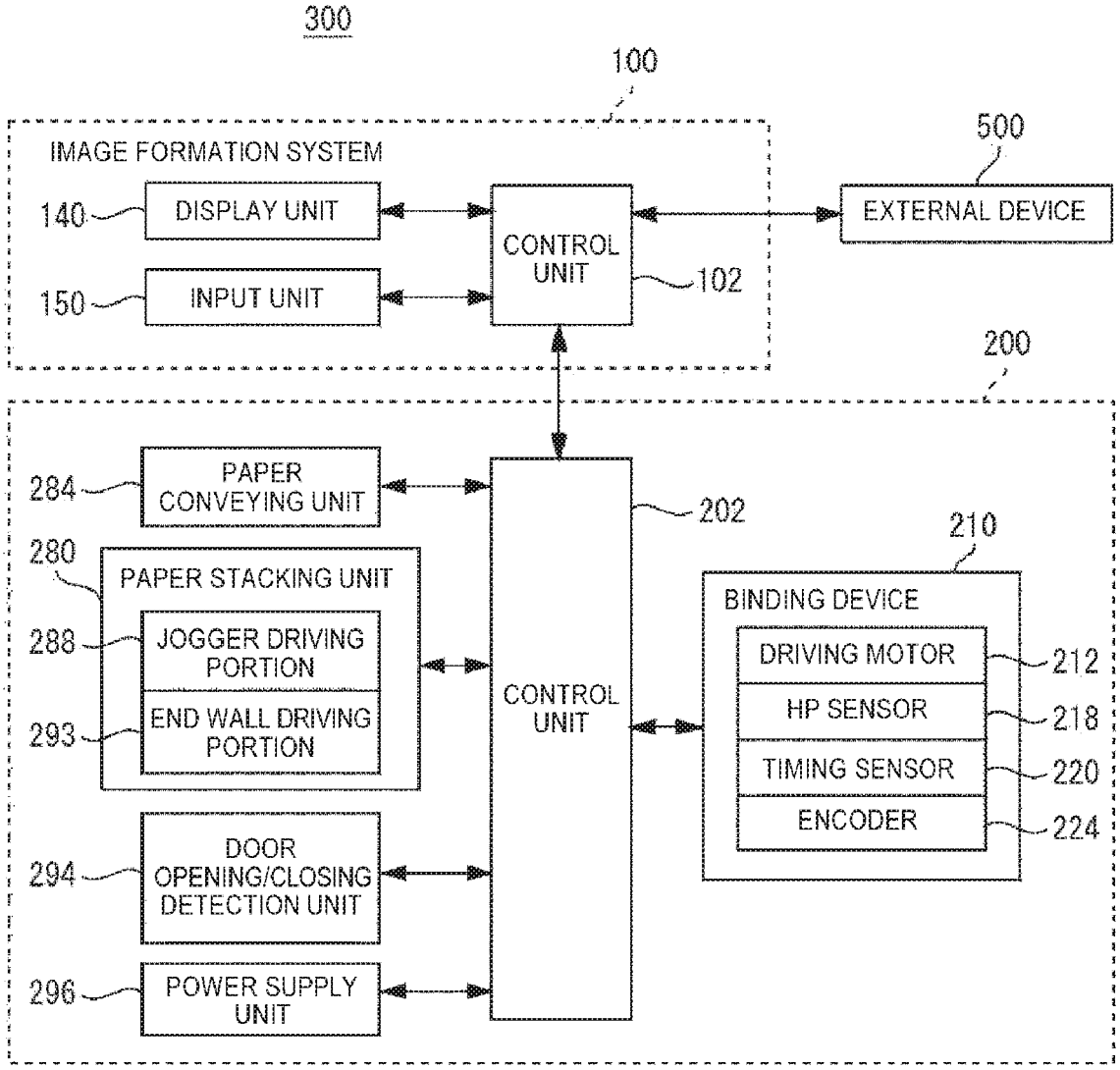
FIG. 31 is a block diagram showing an example of a functional configuration of the image formation system.

FIG. 31 is a block diagram showing an example of a functional configuration of the image formation system 300.

As shown in FIG. 31, the image formation system 300 includes the image formation apparatus 100 and the post-processing apparatus 200.

The image formation device 100 has a control unit 102 for controlling operation of each of components thereof. The control unit 102 has a CPU (Central Processing Unit), a ROM (Read Only Memory) and the like. The CPU is configured to execute various functions related to an image forming processing by reading and executing a program stored in the ROM.

The display unit 140 and the input unit 150 are connected to the control unit 102. The display unit 140 and the input unit 150 are configured to supply information, such as post-processing conditions to be inputted by a user, to the control unit 202 or to display a predetermined image on a screen based on control from the control unit 202.

Also, an external device 550 is connected to the control unit 102 via a network, such as LAN (Local Area Network), as an example. The external device 500 is constructed by a personal computer, a portable information terminal or the like and is configured to communicate with the control unit 102 regarding an image forming processing, such as a printing job.

The post-processing apparatus 200 has a control unit 202 for controlling operation of each of components thereof. The control unit 202 is connected to the control unit 102 of the image formation apparatus 100 and is configured to execute functions related to a post-processing, including crimp-binding, in conjunction with the control unit 102. Like the control unit 102, the control unit 202 has a CPU, a ROM and the like.

A binding device 210, a paper conveying unit 284, a paper stacking unit 280, a door opening/closing detection unit 294 and a power supply unit 296 are connected to the control unit 202.

The binding device 210 has a driving motor 212, a HP sensor 218, a timing sensor 220 and an encoder 224.

The driving motor 212 is driven based on a driving signal supplied from the control unit 202, thereby rotating the eccentric cam 216. Meanwhile, an upper limit for an electric current value supplied to the driving motor 212 may be set, thereby preventing the driving motor 212 from being damaged due to an overcurrent. Further, a short brake, a reverse brake and a return at the time of overrunning may be employed for a stop control of the drive motor 212.

The HP sensor 218 is configured to detect the presence of the detected member 219 indicating whether the eccentric cam 216 is positioned at the home position and then to supply the detected signal to the control unit 202.

The timing sensor 220 is configured to detect the presence of the detected member 221 indicating a rotational position of the eccentric cam 216 and then to supply the detected signal to the control unit 202. For example, if an abnormality, such as failure of the binding device 201, occurs during binding and the timing sensor 220 is on, the eccentric cam 216 has already headed beyond a half position thereof and thus a load is after a peak thereof. Accordingly, the control unit 202 controls the driving motor 212 to return the eccentric cam 216 to the home position by forward rotation. For example, if an abnormality occurs and the timing sensor 220 is off, the eccentric cam 216 has not yet headed up to the half position and thus the load is prior to the peak. Accordingly, the control unit 202 controls the driving motor 212 to return the eccentric cam 216 to the home position by reverse rotation.

The encoder 224 is attached on the motor gear 213 of the driving motor 212 (see FIG. 10) and is configured to detect a rotational speed of the driving motor 212 and then to supply the detected signal to the control unit 202. The control unit 202 is configured to control the rotational speed of the driving motor 212 based on the rotational speed of the driving motor 212 detected by the encoder 224, thereby suppressing, for example, noise of the driving motor 212.

The paper conveying unit 284 is constructed by, for example, a DC motor, a stepping motor or the like and is configured to be driven based on a driving signal supplied from the control 202, thereby rotationally driving conveying rollers the conveyance path R1 or the conveying rollers 282, 283 of the conveyance path R2.

The paper stacking unit 280 has a jogger driving portion 288 and an end wall driving portion 293. The jogger driving portion 288 is constructed by, for example, a DC motor, a stepping motor or the like and is configured to be driven based on a driving signal supplied from the control unit 202, thereby moving the side joggers 286, 287 in the paper width direction.

The end wall driving portion 293 is constructed by, for example, a DC motor, a stepping motor or the like and is configured to be driven based on a driving signal supplied from the control unit 202, thereby moving the end wall 292 to the binding position provided in the paper conveying direction.

The door opening/closing detection unit 294 is configured to detect opening or closing of an openable door provided on the front side of the post-processing apparatus 200 and then to supply the detected signal to the control unit 200. The power supply unit 296 is, for example, an alternating current power supply of 100V and supplies an electric power to the post-processing apparatus 200. The control unit 202 stops supplying an electric power to the post-processing apparatus 200 by controlling the power supply unit 294, if a detected signal from the door opening/closing detection unit 294 is acquired. In this way, when the post-processing apparatus 200 is abnormally stopped or the like, the power supply can be turned off.

[Exemplary Operation of Post-Processing Apparatus 200]

Figure 32:
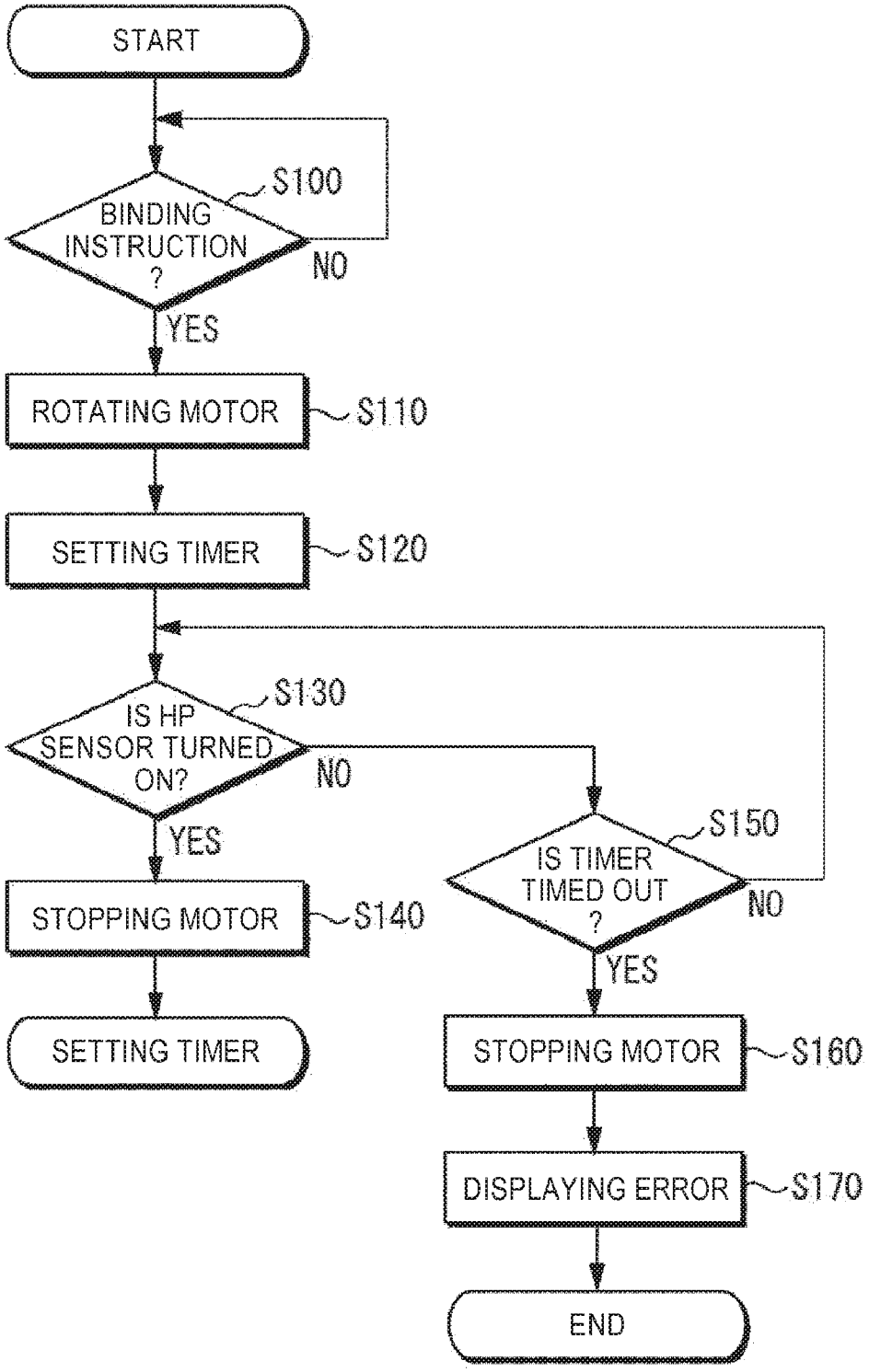
FIG. 32 is a flowchart showing an exemplary operation of the post-processing apparatus when performing a printing job including a binding instruction.

FIG. 32 is a flowchart showing an example of a binding operation including a binding instruction. The CPU of the control unit 202 executes a process shown in FIG. 32 by reading a program from a memory, such as a ROM.

In a step S100, the control unit 202 determines whether or not a printing job including a binding instruction has been transmitted, for example, from the control unit 102 thereto. The control unit 202 proceeds to a step S110 if it is determined that a printing job including a binding instruction has been transmitted, but stands by until a binding instruction is issued, if it is determined that a printing job including a binding instruction has not been transmitted.

In the step S110, the control unit 202 rotationally drives the driving motor 212 if a paper bundle having an image formed thereon is set at the binding position. Therefore, as the eccentric cam 216 rotates once, the teeth 250 are brought into an engaged state from a separated state so that the paper bundle is crimped and bound, thereby producing a booklet.

In a step S120, the control unit 202 sets a timer for determining abnormality while rotationally driving the driving motor 212, and then starts counting.

In a step S130, the control unit 202 determines whether or not the HP sensor is turned on. That is, it is determined whether or not the eccentric cam 216 has rotated once and thus returned to the home position. If the HP sensor 218 has been turned on, the control unit 202 determines that crimping of the paper bundle by the binding teeth 250A has been completed and then proceeds to a step S140 and stops rotation of the driving motor 212.

On the other hand, if the control unit 202 determines in the step S130 that the HP sensor 218 has not been turned on, the control unit 202 proceeds to a step S150. In the step S150, the control unit 202 determines whether or not the set timer has been timed out. If the timer has not been timed out, the control unit 202 determines that the binding processing by the teeth 250 has not yet been ended, and then returns to the step S130 and continues to drive the driving motor 212.

On the other hand, if it is determined that the timer has been timed out, the control unit 202 determines that an abnormality due to failure of the driving motor 212 or the like has occurred, and then proceeds to a step 160 and stops rotational driving of the driving motor 212.

In the step S160, the control unit 202 displays on a screen of the display unit 140 or on a screen of the external device 500 an error sign indicating that the binding processing has not normally ended. In the present embodiment, this process is repeatedly executed.

As described above, according to the present embodiment, the binding teeth 250A and the like are provided with the non-abutting surface portion 265 between the abutting surface portion 264 and the first ridge portion 267*a* or provided with the inclined surface portion 269 between the top surface portion 268 and the second ridge portion 267*b*. As a result, it is possible to reduce a local elongation of sheets of paper P upon crimping. That is, boundaries between the side surface portion 263 and inclined surface portion 269 and the first ridge portion 267*a* and second ridge portion 267*b* can be gently changed. Therefore, tearing in sheets of paper P can be reliably prevented. Also, even an increased pressing load is used for crimping, tearing in sheets of paper P can be prevented. As a result, it is possible to increase the number of sheets to be bound by increasing a pressing load. For example, even if a paper bundles of about five to ten sheets is bound by crimp-binding, the binding processing can be satisfactorily performed.

Further, according to the present embodiment, a point, at which peeling of a crimp-bound booklet is started, and a point, at which the booklet is crimped, are made close to each other, thereby enhancing a retention force at the bound portion of the booklet bundle.

Meanwhile, although the present invention has been described with reference to the foregoing embodiments, the technical scope of the invention is not limited to the scope as described in the foregoing embodiments. Various modifications or improvements may be added to the foregoing embodiments without departing from the spirit of the invention.

Although the example, in which both side surface portions 263 of all the tooth portions 262 of the binding teeth 250A and the like are provided with the non-abutting surface portion 265, has been described in the foregoing embodiments, the present invention is not limited thereto. For example, one side surface portion 263 of the tooth portions 262 may be provided with the non-abutting surface portion 265, or only specific tooth portions 262 of a plurality of tooth portions 262 may be provided with the non-abutting surface portion 265. Further, only one of the lower tooth 260 and the upper tooth 270 may be provided with the non-abutting surface portion 265. In addition, the same is also applied to the inclined surface portion 269.

Also, although the example, in which the binding device 210 is equipped in the post-processing apparatus 200, has been described in the foregoing embodiments, the present invention is not limited thereto. The binding device 210 may be equipped in the image formation apparatus 100. In this case, the binding device 210 is installed downstream of the fixing unit 120 in the paper conveying direction D.

Further, although the case, in which a corner of a paper bundle is crimp-bound by the binding device 210, has been described in the foregoing embodiments, the present invention is not limited thereto. Crimp-binding may be performed on the vicinity of a folded portion of a center-folded booklet, thereby producing the booklet. In this case, it is preferable that an array direction of unevenness formed by crimp-binding extends along the folded line.

In addition, although the case, in which the tooth portions 262 of the binding teeth 250A and the like are arrayed in a linear shape, has been described in the foregoing embodiments, the present invention is not limited thereto. For example, instead of the linear shape, the lower tooth 260 and the upper tooth 270 may be arrayed in a curved shape or circular shape and also may be arrayed in a plurality of rows or in a lattice shape.

This application is based on Japanese Patent Application Serial No. 2016-109564 filed on May 31, 2016, the entire contents of which are incorporated herein by reference.

REFERENCE NUMERALS LIST

100 Image formation apparatus
200 Post-processing apparatus (paper processing apparatus)
212 Driving motor (drive unit)
230 Binder
232 Pressing lever
234 Upper arm (drive unit)
236 Lower arm (drive unit)
242 Arm fulcrum portion (shaft portion)
250A, 250B, 250C, 250D, 250E, 250F Binding teeth
260 Lower tooth (first tooth)
262 Tooth portion
263 Side surface portion
264 Abutting surface portion
265 Non-abutting surface portion
267*a* First ridge portion
267*b* Second ridge portion
267*c* Third ridge portion
268 End surface portion (front surface portion)
269 Inclined surface portion
270 Upper tooth (second tooth)
280 Paper stacking unit (stacking unit)
284 Paper conveying unit (conveying unit)
300 Image formation system

The invention claimed is:

1. A pair of tooth portions, including a first tooth portion and a second tooth portion, each having a plurality of convex portions and arranged to engage with each other when approaching each other, wherein one convex portion of the plurality of convex portions of the first tooth portion engages with a corresponding one convex portion of the plurality of convex tooth portions of the second tooth portion, wherein the one convex portion of the first tooth portion has an abutting surface abutting against the corresonding one convex portion of the second tooth portion when the first and second tooth portions are engaged with each other, the one convex portion of the first tooth portion further including a non-abutting surface not abutting against the corresponding one convex portion of the second tooth portion when the pair of tooth portions are engaged with each other, wherein the one convex portion has an end surface configured as a surface which is bent from one end side of the one convex portion, and wherein the non-abutting surface is provided between the abutting surface and the end surface.

2. The pair of tooth portions according to claim 1, wherein the one convex portion includes a top surface, wherein the top surface is inclined.

3. The pair of tooth portions according to claim 1, wherein the plurality of convex portions of each of the pair of tooth portions are arranged in a row in a predetermined direction.

4. The pair of tooth portions according claim 1, wherein the non-abutting surface of the one convex portion of the first tooth portion and a non-abutting surface of the corresponding one convex portion of the second tooth portion are configured such that, when the first and second tooth portions are engaged with each other, a distance between the non-abutting surface of the one convex portion and the non-abutting surface of the corresponding one convex portion is increased toward the end surface.

5. The pair of tooth portions according to claim 3, wherein the plurality of convex portions of each of the pair of tooth portions have at least two different longitudinal lengths.

6. The pair of tooth portions according to claim 1, wherein, when the first and second tooth portions are engaged with each other, a side surface separation distance is 0.23 mm or greater and 0.35 min or smaller.

7. A binder comprising:

the pair of tooth portions according to claim 1; and a drive unit capable of driving the pair of tooth portions to be brought into contact with or separated from each other.

8. A paper processing apparatus comprising:

a conveying unit configured to convey sheets of paper;

a stacking unit configured to stack sheets of paper conveyed by the conveying unit; and the binder according to claim 7 configured to bind a bundle of sheets of paper stacked by the stacking unit.

9. The paper processing apparatus according to claim 8 comprising a position control unit configured to control a position of the binder relative to the bundle of sheets of paper, wherein the one convex portion has an end surface configured as a surface which is bent from one end side, and wherein the position control unit is configured to control the position of the binder in such a manner that the end surface faces a center of the bundle of sheets of paper.

10. An image formation system comprising:

an image formation apparatus configured to form an image on sheets of paper;

a conveying unit configured to convey the sheets of paper having the image formed by the image formation apparatus;

a stacking unit configured to stack sheets of paper conveyed by the conveying unit; and the binder according to claim 7 configured to bind a bundle of sheets of paper stacked on the stacking unit.

11. A tooth arrangement configured to crimp and bind a paper bundle by engaging a pair of a first tooth and a second tooth, wherein the first tooth has a top surface portion, a front surface portion, a side surface portion, an inclined surface portion provided between the top surface portion and the front surface portion, and a third ridge portion provided between the inclined surface portion and the side surface portion, wherein the second tooth has a top surface portion, a front surface portion, a side surface portion, an inclined surface portion provided between the top surface portion and the front surface portion, and a third ridge portion provided between the inclined surface portion and the side surface portion, wherein, when the first tooth and the second tooth are engaged with each other with a predetermined gap interposed therebetween, a half of a length of a linear part of the inclined surface portion of the first tooth is A; a half of a length of a linear part of the inclined surface portion of the second tooth is B; a length of a common tangent part of the third ridge portion of the first tooth and the third ridge portion of the second tooth is C; a length from an intersection point between the third ridge portion of the first tooth and the linear part of the inclined surface portion of the first tooth to the common tangent part is D; a length from an intersection point between the third ridge portion of the second tooth and the linear part of the inclined surface portion of the second tooth to the common tangent part is E; a length between the center point of the linear part of the inclined surface portion of the first tooth and the center point of the linear part of the inclined surface portion of the second tooth is F; and an elongation rate is $(A+B+C+D+E)/F$, and when the first tooth and the second tooth e engaged with each other with a predetermined gap interposed therebetween, the elongation rates as measured at two different locations on the first tooth and the second tooth in a longitudinal direction thereof are X and Y respectively; a distance between the location of the elongation rate X and the location of the elongation rate Y is Z; and a rate of change in elongation rate is $(Y-X)/Z$, the rate of change in elongation rate is 0.4 or smaller.

* * * * *